United States Patent [19]

Yoshida et al.

[11] Patent Number: 4,460,668

[45] Date of Patent: Jul. 17, 1984

[54] ELECTROPHOTOGRAPHIC COPYING METHOD

[75] Inventors: Masazumi Yoshida, Amagasaki; Tadao Noda, Sakai; Masayoshi Inoue, Itami, all of Japan

[73] Assignee: Minolta Camera Kabushiki Kaisha, Osaka, Japan

[21] Appl. No.: 454,975

[22] Filed: Jan. 3, 1983

Related U.S. Application Data

[63] Continuation of Ser. No. 275,583, Jun. 10, 1981, abandoned, which is a continuation-in-part of Ser. No. 189,005, Sep. 22, 1980, abandoned.

[30] Foreign Application Priority Data

Oct. 18, 1979 [JP] Japan ..... 54-134807
Oct. 19, 1979 [JP] Japan ..... 54-135398
Jul. 11, 1980 [JP] Japan ..... 55-95310

[51] Int. Cl.[3] ..... G03G 13/22

[52] U.S. Cl. ..... 430/31; 430/94; 430/902; 355/3 CH; 355/3 R

[58] Field of Search ..... 430/31, 55, 94, 902

[56] References Cited

U.S. PATENT DOCUMENTS 3,655,369 4/1972 Kinoshita ..... 430/51
4,063,811 12/1977 Seino et al. ..... 355/15
4,142,889 3/1979 Tanaka et al. ..... 430/94 X
4,175,955 11/1979 Seino et al. ..... 430/94 X
4,229,511 10/1980 Katoh ..... 430/55
4,262,075 4/1981 Noda et al. ..... 430/55
4,286,032 8/1981 Ito et al. ..... 430/55

*Primary Examiner*—Roland E. Martin, Jr.
*Attorney, Agent, or Firm*—Watson, Cole, Grindle & Watson

[57] ABSTRACT

An electrophotographic copying method suitable for a toner image transfer type copying apparatus is disclosed. Using a photosensitive member which comprises at least a photoconductive layer formed over a conductive base which is prepared from a dispersion of a photoconductive material including at least cadmium sulfide in a binder resin and in which a portion of photosensitive member is used repeatedly for forming an image of original to be copied, the method is characterized by performing a first step of charging said photosensitive member to high potential and to the same polarity as applied thereto for the formation of electrostatic latent images and subsequently exposing to light to sensitize said photosensitive member, said high potential being high enough to saturate the degree of sensitization; and a second step of charging the photosensitive member after the first step, and subsequently exposing the photosensitive member to an optical image to form an electrostatic latent image thereon.

6 Claims, 31 Drawing Figures

ELECTROPHOTOGRAPHIC COPYING METHOD

REFERENCE TO RELATED APPLICATION

This is a Continuation of application Ser. No. 275,583 filed June 10, 1981, now abandoned, which is a continuation-in-part of application Ser. No. 189,005 filed on Sept. 22, 1980 and now abandoned.

FIELD OF THE INVENTION

The present invention relates to an electrophotographic copying method, and more particularly to an electrophotographic copying method suitable for the toner image transfer type copying apparatus which employs a photosensitive member (hereinafter referred to as "photosensitive member of the type mentioned") comprising a conductive substrate, a photoconductive layer formed over the substrate which is prepared from a dispersion of a photoconductive material including at least cadmium sulfide in a resin binder, and only if necessary an insulating protective layer formed on the photoconductive layer.

BACKGROUND OF THE INVENTION

Photosensitive members of the type mentioned have exceedingly higher mechanical properties in respect of surface hardness and abrasion resistance and are more resistant to heat and moisture than other photosensitive members including a photoconductive layer which is prepared from an inorganic photoconductive material, such as amorphous selenium alloy or zinc oxideresin mixture, or an organic photoconductive material, such as polyvinylcarbazole or polyvinylnaphthalene. Moreover, such photosensitive members permit application to the semiconductor laser printer as they have photosensitivity not only in the visible light spectrum, but also in the near-infrared spectrum, and are also less retentive of a residual potential. Thus, they have outstanding characteristics as photoconductive elements for repeated use and are useful in the form of a drum for electrophotographic copying apparatus. However, an attempt to reduce the diameter of the drum to provide an apparatus of smaller size entails the following serious problem.

When such a photosensitive drum is used as a xerographic element in copying apparatus of the known toner image transfer type, the photoconductive surface is subjected during single rotation of the drum to the successive steps of charging, exposure to an optical image, development, transfer of a toner image and erasing of the residual charges. If the drum has a reduced diameter, for example, of about 120 mm there arises the problem that the front half fogging phenomenon or memory phenomenon to be described below stains the copy image and seriously impairs the quality of the image.

For instance, a photosensitive drum with a small diameter of about 120 mm has a circumference of about 377 mm, so that when the drum is used, the drum must be driven more than one rotation to use a same portion of the photosensitive surface for completing a single copying cycle. (For example, when making a life-size copy of an original of A3 size which has a length of 420 mm, about 11% of the photoconductive surface must be used in repetition.) The front half of the copy image corresponding to the first revolution of the drum then becomes fogged (front half fogging or first drum rotation effect), or the front half (corresponding to the first rotation of the drum) of the image overlaps the latter half of the copy image corresponding to the repeatedly used portion of the drum (memory effect). Thus the copy image becomes stained markedly.

These phenomena are attributable to the presence of various impurities in the finely divided photoconductive material including at least cadmium sulfide which forms the photosensitive member of the type mentioned, to the imperfections, such as lattice defects and lattice irregularities, in the material, and further to the presence of numerous sites (hereinafter referred to as "traps") for capturing charge carriers (hereinafter referred to simply as "carriers") which sites or traps are formed at the interface between the fine particles of the photoconductive material or between the material and the binder resin. More specifically stated, since carriers produced by the charging-image projection process during the first rotation of the drum fill traps, carriers similarly produced during the second rotation of the drum having a prolonged average lifetime $\tau_T$ before being captured in traps, consequently giving higher photosensitivity to the photosensitive member during the second rotation of the drum than during the first rotation. This leads to front half fogging. Furthermore, there is a difference in the degree of trap filling between the non-image area (illuminated area where carriers are produced) on the drum and the image area (unilluminated area where no carriers are formed) during the first rotation of the drum, with the result that the photosensitivity of the drum during the second rotation differs from location to location relative to the image pattern on the drum during the first rotation, consequently producing a memory effect.

The stains on copy images, such as front half fogging due to the unevenness in the rate of trap filling with respect to time and the memory effect due to the unevenness in the degree of trap filling with respect to location, can be prevented by releasing carriers from traps to empty the traps every time the drum is driven one turn, using a residual charge eraser of sufficiently high illumination. For this purpose, U.S. Pat. No. 4,175,955 has proposed an erasing process which uses optical means of very high intensity illumination of 10,000 to 20,000 Lux. Although effective for preventing front half fogging and memoery effects, this process has the drawback that when the apparatus is initiated into a continuous copying operation following a cessation of a prolonged period of time, several to several tens of copies initially obtained have an increased image density due to a reduction in the photosensitivity. (This phenomenon will hereinafter be referred to as "sensitivity variations after a cessation".)

This phenomenon, i.e., sensitivity variations after a cessation becomes particularly notable if an overcoat layer or a transparent insulating protective layer having fine characteristics in smoothness and mechanical strength is formed over the photoconductive layer. The reason for this is because space charges are gradually accumulated in the boundry between the photoconductive layer and the protective layer during continuous copying thereby gradually increasing residual potential until a certain equilibrium state is reached and as the result thereof, surface potentials of the photosensitive member corresponding to image and non-imaged portions of original increase along with increase of number of copying. In other words, photosensitivity of photosensitive member is reduced. Such sensitivity reduction makes it impossible to obtain copies by a continous operation with a constant amount of exposure and necessitates an inconvenient exposure adjusting procedure.

Whereas the sensitivity variations after a cessation can be diminished by the use of a reduced amount of erasing illumination contrary to the above-mentioned high intensity illumination erasing process, stained copy images are then more likely to result due to front half fogging or memory effects. Although there is a pressing need for high reliability in recent years, copying apparatus presently available still remain to be improved in this respect.

It is also desired to provide copying apparatus which are operable at a higher speed with use of a photoconductive member of improved sensitivity, but it is in no way easy to improve the sensitivity alone several times or higher while fulfilling the desired characteristics and fabrication requirements with stability.

SUMMARY OF THE INVENTION

It is accordingly a primary object of the present invention to provide a novel and improved electrophotographic copying method of the toner image transfer type which is simple in its construction and which is capable of producing copy images free from stains due to front half fogging or memory effects and which can be practiced without involving sensitivity variations after a cessation.

Another object of the present invention is to provide an electrophotographic copying method of the toner image transfer type which uses a photosensitive member of the type mentioned and in which a pre-hysteresis effect peculiar to this type of member is utilized for a process for sensitizing the member to achieve an improved copying speed.

Still another object of the present invention is to provide an electrophotographic copying method which is capable of normal copying not only in the visible light spectrum but is also capable of producing copies at high speed in the long wavelength spectrum of about 7,000 to 8,500 Å which is the light emitting spectrum for a semiconductor laser, thereby permitting the method to be applicable to a semiconductor laser beam printer.

These and other objects of the present invention are achieved by providing an electrophotographic copying method of the toner image transfer type which uses a photosensitive member comprising a conductive base, a photoconductive layer formed over the base which is prepared from a dispersion of a photoconductive material including at least cadmium sulfide in a resin binder, and if necessary an insulating protective layer formed over the photoconductive layer and in which at least a portion of the photosensitive member is used repeatedly for completing a single copy. The method is characterized by performing a prehysteresis sensitizing step of charging the photosensitive member to the same polarity as applied thereto for the formation of electrostatic latent images and thereafter exposing the photosensitive member to light to saturate its degree of sensitization, charging the photosensitive member after the sensitizing step, and subsequently exposing the photoconductive member to an optical image to form an electrostatic latent image thereon.

For a fuller understanding of the nature and objects of the present invention, reference is made to the following detailed description taken in conjunction with the accompanying drawings.

DESCRIPTION OF THE PREFERRED EMBODIMENTS

Figure 1:
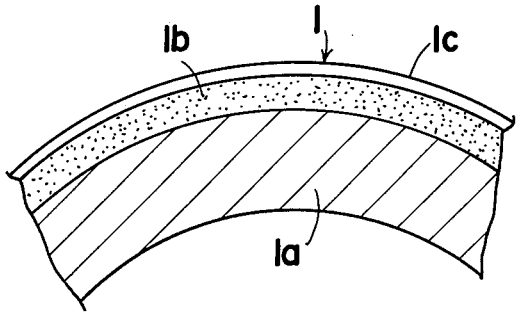
FIG. 1 is a partial cross-sectional view of a photosensitive member with an insulating protective layer suitable for use in the present invention.

As shown in FIG. 1, photosensitive member 1 suitable for use in the present invention includes a conductive substrate 1*a* such as alminum and preferably in a form of drum, a photoconductive layer 1*b* formed over the substrate 1*a* and, only if necessary, an insulating protective layer 1*c* formed over the photoconductive layer 1*b*. Photoconductive materials for the photoconductive layer 1*b* should include at least cadmium sulfide, and in particular, the photoconductive material is preferably selected from the group consisting of (1) $CdS_xSe_{1-x}.nCdCO_3$ ($0.1\leqq x\leqq 1$; $0<n\leqq 4$), (2) CdS and (3) $(CdS)_x(CdSe)_{1-x}.nCdCO_3$ ($0.1\leqq x\leqq 0.99$; $0<n\leqq 4$). As may be apparent photoconductive material (1) is represented by the formula $CdS.nCdCO_3$ when x equals to 1.

The photoconductive layer 1*b* is formed by a dispersion of one of the above desired photoconductive materials in a resin binder which is then coated onto the conductive substrate in a thickness of about 10 to 60 microns. The coating is then heat cured. Any kind of resin binder may be used as long as it is heat curable and the same may suitably be selected from one or a combination or acryl resins, amino resins, epoxy resins, silicone resins, fluorine resins, polyester resins and vinyl resins. If desired, a small amount of an activator such as copper, silver or halogen and a stearate metallic salt such as manganese stearate may be added to the photoconductive layer.

In addition, the photosensitive member suitable for use in accordance with the present invention may include the light transparent insulating protective layer 1*c* covering the photoconductive layer 1*b*. Such protective layer preferably will be characterized by suitable surface smoothness, surface hardness and mechanical strength and should be effective to prevent occurrence of what is known as filming phenomenon resulting in image contamination caused by the tendency of residual toner to become buried in the photosensitive member when an elastic blade in contact with the surface of photosensitive member is used as a residual toner removing means. As the material for this protective layer, any one or more of the above-mentioned thermally curable resins can be used and the thickness thereof may be about 0.05 to 5 microns. Silicone additives may be added to reduce the frictional coefficient of the protective layer 1*c*.

In accordance with the present invention, the inventors have conducted extensive research to overcome the foregoing drawbacks and have found that the photosensitivity of the photosensitive member of the type mentioned which has numerous traps increases with the average lifetime $\tau_T$ of carriers before they are captured in traps, when the distance of movement or carriers, $\mu E\tau_T$ ($\mu$: mobility of carriers, E: intensity of electrical field), is smaller than the thickness L of the photoconductive layer, and that since the average lifetime $\tau_T$ is proportional to the reciprocal of the number of empty traps, the carriers have a longer lifetime $\tau_T$ with longer range and afford increased sensitivity (so-called pre-hysteresis effect) if the traps are filled in advance by some means. These findings have matured to the present invention.

Figure 3:
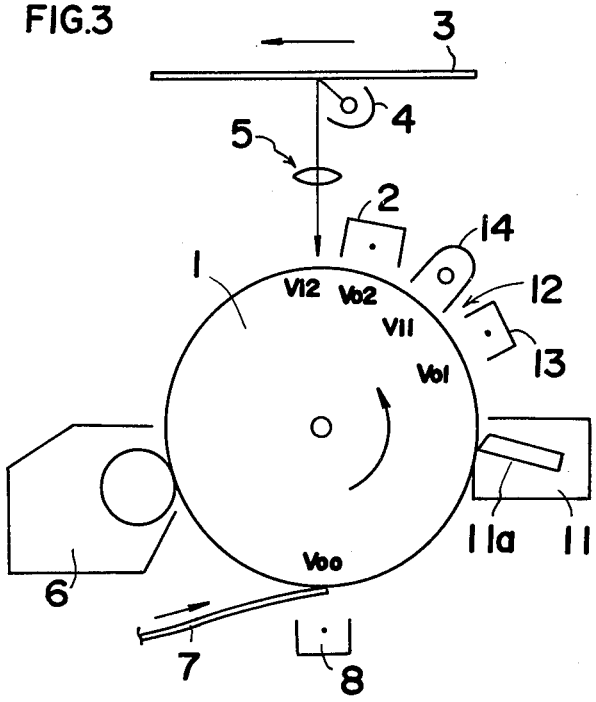
FIG. 3 is a diagrammatic cross-sectional view of a toner image transfer type electrophotographic copying apparatus employing a copying method in accordance with the present invention.

Referring to FIG. 3 schematically showing an electrophotographic copying apparatus of the powder toner image transfer type according to the invention, indicated at 1 is a photosensitive drum rotatably supported on a shaft. Arranged around the drum 1 along the direction of its rotation are a main corona charger 2 for uniformly charging the surface of drum 1, an optical system 5 for exposing the drum 1 to light to form an electrostatic latent image thereon, a developing unit 6 for converting the latent image to a visible image by magnetic brush development, a corona charger 8 for transferring the visible toner image onto copy paper 7 sent forward from a feeder, and a cleaning unit 11 with an elastic blade 11*a* in contact with the surface of drum 1 for removing the developer remaining on the drum surface. The drawing also shows an original 3 and the exposure lamp 4 of the optical system 5. In addition to the usual arrangement described above, the apparatus for the present invention includes a sensitizing unit 12 disposed between the transfer charger 8 and the main corona charger 2 of the same polarity as the transfer corona charger 8 and comprising a pre-hysteresis sensitizing corona charger (hereinafter referred to as "sub-charger") 13 of the same polarity as the chargers 2 and 8, and a pre-hysteresis light eraser (hereinafter referred to as "eraser") 14. With the above apparatus, a lamp of low illumination is usable as the eraser 14 instead of using one of high illumination. In addition, the apparatus is so arranged that the time required for the portion of photosensitive drum 1 sensitized by the sensitizing unit 12 to reach the main corona charger 2 is set to be less than about 3 seconds at maximum.

Figure 4:
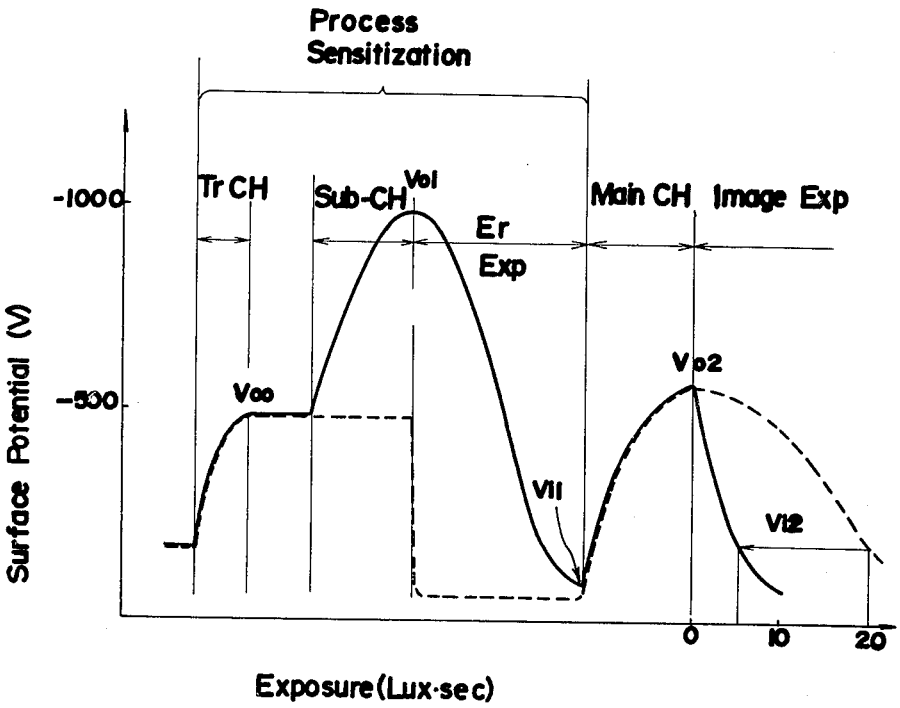
FIG. 4 is a graph showing changes in surface potential of the photosensitive member in accordance with the copying method of the present invention.

The apparatus described above was operated with the photoconductive drum 1 driven at a constant speed to determine the drum for the surface potentials of: $V_{00}$ applied by the transfer charger 8 (identified as Tr CH), $V_{01}$ applied by the sub-charger 13 (Sub CH), $Vi_1$ after illumination by the eraser 14 (Er Exp), $V_{02}$ applied by the main charger 2 (Main CH) and $Vi_2$ after exposure to an optical image (Image Exp). The variations in the surface potentials on the drum are indicated in a solid line in FIG. 4. The broken line in FIG. 4 shows the varying surface potentials on the photoconductive drum of an apparatus which is not provided with the sensitizing unit 12 but includes a conventional eraser of high illumination described in U.S. Pat. No. 4,175,955. The light decay curves illustrated indicate that at the same charge potential $V_{02}$ (−600 V) the rate of decay during exposure to the image is exceedingly higher in the method according to the present invention than in the conventional process. When compared in sensitivity in terms of the amount of exposure needed for the potential $Vi_2$ to reach −200 V, the known high-illumination erasing process requires about 20 lux.sec whereas in the present method, only about 5 lux.sec is needed if $CdS.nCdCO_3$ photoconductive material is used in the photosensitive member with the protective layer. This indicates that the present method achieves sensitization of about four times the photosensitivity afforded by the known process. Similarly, if $CdS_xSe_{1-x}.nCdCO_3$ is used, the conventional process will require about 8 lux.sec to decay to $Vi_2$ (+200 V) from $V_{02}$ (+600 V) whereas only about 2.5 lux.sec is needed in the present invention indicating that the photosensitive member is sensitized more than three times than with the known process.

The sensitizing process will be described with reference to FIGS. 3 and 4. With electrophotographic copying apparatus of the toner image transfer type, the photosensitive member 1 is charged to a sufficiently high surface potential of, for example, −100 V by the main corona charger 2 and the prehysteresis corona charger 13 of same polarity as the transfer charger 8. Consequently, when the subsequent pre-hysteresis exposure by the eraser 14 does not afford excessive exposure (high illumination), the photosensitive member is given charging-exposure pre-hysteresis and is thereby sensitized in this step. While the sensitization is effected only in a single step in the present invention, uneven filling of traps is remedied to enhance the sensitivity as well as to prevent the staining of images resulting from front half fogging and memory when the pre-hysteresis charge potential is set sufficiently high to saturate the dependency of the degree of sensitization of the surface potential. In other words, the transfer of developed image from the photosensitive drum 1 to plain paper is performed usually with use of a transfer corona charger such as the one indicated at 8 in FIG. 3 and by this, the drum will be charged by the transfer charger 8. Since the surface potential $V_{00}$ at this point of time is added to the surface potential $Vi_2$ after optical image exposure, it is subjected to influences of $Vi_2$ and $V_{00}$ on the surface of drum (that are different in the portion corresponding to the image area (non-exposed portion where $Vi_2$ is high) and in the portion corresponding to background or non-image area (exposed portion where $Vi_2$ is low). In addition, the surface potential $V_{00}$ would also vary depending on the presence of copying paper. To be specific, the surface potential $V_{00}$ would be about −650 V in the absence of paper or about −500 V in the presence of paper even if the other chargers are held deenergized. Thus, $V_{00}$ would vary in the image and background portions and also depending on the presence of paper. If the photosensitive drum 1 is sensitized only by the charging to $V_{00}$ by the transfer charger 8 and by the exposure with the eraser 14 with the pre-hysteresis charger 13 remained deenergized, $V_{00}$ will not be sufficiently high. Since the degree of sensitization is dependent on the pre-hysteresis charge potential (which in this case is $V_{00}$), $V_{00}$ would vary from location to location in the portions corresponding to image and non-image portions as well as in the portions where paper has and has not passed. These variances in $V_{00}$ cause unevennesses in filling of traps and this results in uneven sensitivity of the photosensitive drum to cause the memory phenomenon.

However, the degree of sensitization levels off or saturates in the region of sufficiently high pre-hysteresis potential so that by charging the drum to sufficiently high potential of $V_{01}$ by adding to or loading over $V_{00}$ as shown in FIG. 4 with the provision of the sub-charger 13 between the transfer charger 8 and the eraser 14 as in the present invention, the degree of sensitization on the drum becomes substantially even or uniform to thereby prevent the staining of images resulting from the memory and front half fogging even though the surface potential $V_{01}$ is uneven from location to location.

In addition, the decrease in sensitivity after a cessation is effectively prevented in the present invention because the drum is sensitized not by excessively high erasing light intensity, but by sufficiently low or weak erasing light intensity and this in turn compensates the decrease in sensitivity after a cessation by its sensitization so that copies the same density will be obtained during the continuous copying under the same amount of exposure.

Accordingly, the distinct features in the copying method according to the present invention are in the provision of only one corona charger for pre-hysteresis charging between the transfer charger and the light eraser so as to limit the increase of number of elements to a minimum and in the use of a photosensitive member in the saturated region of sensitization by setting the pre-hysteresis charge potential sufficiently high.

In the present invention, it is only after the process through the pre-hysteresis sensitization, that photosensitive drum 1 is charged by the main charger 2 and then exposed to an image of an original by the optical system 5 to form an electrostatic latent image thereon. The latent image is then developed by the magnetic brush developing device 6 for subsequent transfer onto the copying paper 7 by the transfer charger 8.

Thus by the copying method of the present invention, the same photosensitive drum is electronically adjustable to one to several times the original sensitivity thereof. This facilitates an increase in the speed of copying operation. The process also prevents variations in the sensitivity following a cessation, or staining of toner images, such as front half fogging or memory effect, giving greatly increased reliability to the copying apparatus. Furthermore, when copying machines include photosensitive members of somewhat varying characteristics, the sensitizing means of the invention, if provided, serves to impart uniform characterisitcs to the machines, consequently giving greater latitude in the variations of the characteristics of the photosensitive members per se. Photosensitive members can therefore be fabricated with an improved yield, with a substantial reduction in the limitations involved and at a lower cost, while they are usable with enhanced interchangeability and with a greatly facilitated maintenance procedure. These are outstanding advantages afforded by the sensitizing method.

Figure 5:
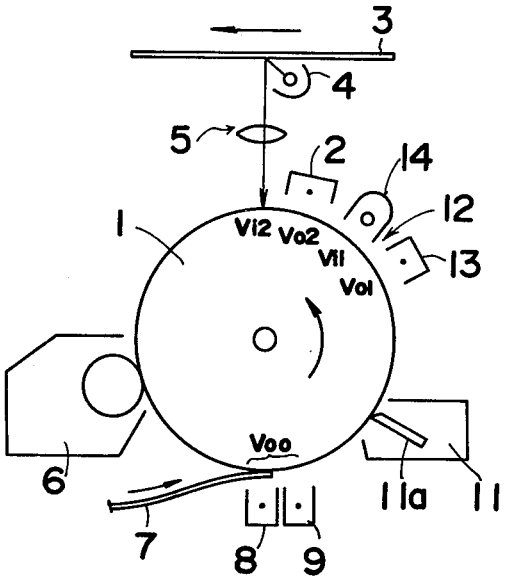
FIGS. 5 to 7 are diagrammatic cross-sectional views of modified electrophotographic copying apparatuses each employing the copying method in accordance with the present invention.

The apparatus according to the invention is not limited only to the one shown in FIG. 3 but can of course be modified variously. As shown in FIG. 5, for example, the arrangement of FIG. 3 may further be provided with an A.C. stripping charger 9 disposed adjacent the transfer charger 8 for releasing the paper from the drum 1 easily. With the modified arrangement, the drum surface potential $V_{00}$ after the drum has been charged is the surface potential after the drum has been discharged to some extent by the A.C. stripping charger 9 subsequent to the charging by the transfer charger 8.

Figure 6:
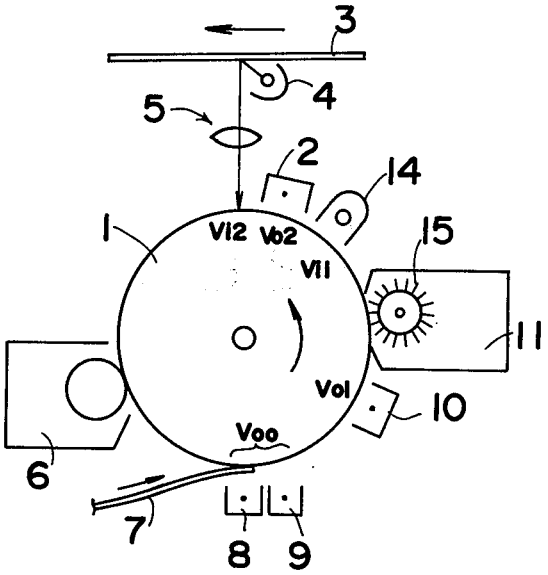

FIG. 6 shows another modification in which the arrangement of FIG. 3 is provided with a fur brush 15 in place of the blade 11*a* of the cleaning unit 11 for removing the residual toner. To render the drum cleanable effectively, a corona charger 10 having the same polarity as the transfer charger 8 is disposed on one side of the cleaner unit 11 closer to the charger 8. In this case, the corona charger 10 serves also as the pre-hysteresis charger and $V_{01}$ is the surface potential charged by this charger.

Figure 7:
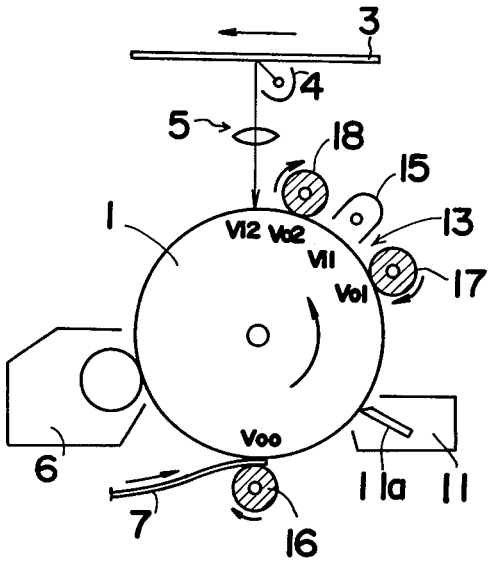

FIG. 7 shows further modification of the arrangement of FIG. 3 in which the main charger 2, transfer charger 8 and the sub-charger 13 each using a corona charging unit with corona wires are replaced by electroconductive rollers 16, 17 and 18 in contact with or in close proximity of about several to several tens microns with the surface of photosensitive drum 1. Sufficient amount of voltages are applied between these rollers and the photosensitive drum 1 to cause discharges therebetween to transfer charges onto the drum surface for charging the same. Advantages by the use of electroconductive rollers instead of those of corona charging units are that charging efficiencies are extremely high as all of the discharge current will flow into the photosensitive drum and that generation of ozone is substantially prevented thereby. Accordingly, any type of charging means may be used in the present invention as long as it has the capability of uniformly charging the photosensitive member.

Figure 8:
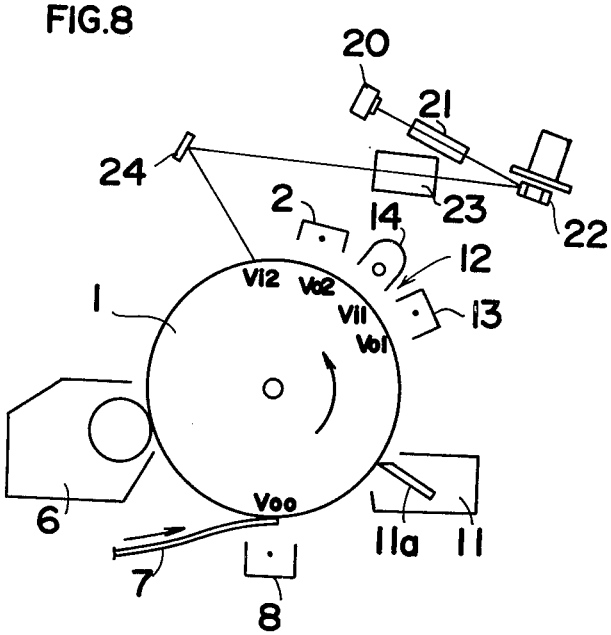
FIG. 8 is a diagrammatic cross-sectional view of a laser beam printer employing the copying method in accordance with the present invention.

FIG. 8 shows an embodiment of a laser beam printer employing the copying method of the present invention and using a semiconductor laser as an image exposure source. As will be further explained hereinafter, photosensitive members used in the present invention exhibit high spectral photosensitivity in the long wavelength region of about 7000 to 8500 Å by the process-wise sensitization enabling them applicable for use in the laser beam printer. The basic arrangement shown in FIG. 8 is same as that of FIG. 3 and includes a semiconductor laser 20 with an exposure wavelength of 7600 Å, a converting optical unit 21, multi-facet mirror 22, an F-$\theta$ lens 23 and a reflecting mirror 24. In projecting an image successively onto the photosensitive drum, a laser beam from the semiconductor laser 20 which is modulated (ON-OFF) by image signals is converted by the converting optical unit 21 and then scanned by the multi-facet mirror 22 in the length-wise direction of photosensitive drum 1 while the compensation of scanning rate and image focussing are effected by the F-$\theta$ lens 23 for projection onto the photosensitive drum 1 through the reflecting mirror 24.

Although different from the first embodiment of FIG. 3 in detailed construction, these modifications operate substantially in the same manner as the first embodiment which is of the most basic construction. Accordingly, the present invention will be described with reference to the following examples in which the apparatus of FIG. 3 was used.

Photosensitive member A

Here, a resin binder type photosensitive member using $CdS.nCdCO_3$ (n=1) as the photoconductive material was prepared.

An aqueous solution containing 308.5 grams of cadmium nitrate and 0.16 grams cupric chloride was admixed with an aqueous solution of ammonium carbonate to form an precipitate of $CdCO_3$(Cu). Next, this precipitate was dispersed in an aqueous solutin of hydrogen sulfide to form a precipitate of CdS(Cu).n$CdCO_3$(Cu). Subsequently, the precipitate was rinsed, dried, ground and calcined at a temperature of 250° C. for 15 hours to obtain photoconductive fine powder. This fine powder was then dispersed in a solution of 90 grams of thermosetting acrylic resin (Acrydic A 405 available from Dainippon Ink. Co.) and 250 milliliters of an organic solvent mixture consisting chiefly of xylene together with 2 parts by weight of manganese stearate per 100 parts by weight of said powder. The mixture was thoroughly kneaded, then applied by spraying onto an aluminum drum 120 mm in diameter and thereafter cured by heating to prepare a photosensitive member A in a form of a drum having a photoconductive layer about 30 microns in thickness.

Photosensitive member B

Here, a resin binder type photosensitive member the same as A but with an insulating protective layer 1*c* was prepared.

After formation of the photoconductive layer in an identical manner as photosensitive member A, a solution containing an organic solvent mixture consisting chiefly of xylene with 5% by weight of thermosetting acryl resin was coated onto the photoconductive layer into a thickness of about 1 micron by spraying and then heat cured to form the insulating protective layer.

Photosensitive member C

Here, a resin binder type photosensitive member using $CdS_xSe_{1-x}.nCdCO_3$ (x=0.7, n=1) was prepared.

An aqueous solution containing 308.5 grams of cadmium nitrate and 0.16 grams of cupric chloride were admixed with an aqueous solution of ammonium carbonate to form a precipitate of $CdCO_3$(Cu). Next, an aqueous solution containing 23.85 grams of ammonium sulfide and 19.5 grams of ammonium selenide was dropped by small amounts into the above solution mixture to thereby obtain a precipitate of $CdS_{0.7}Se_{0.3}.nCdCO_3$. This precipitate was then rinsed, dried, ground and calcined at a temperature of 250° C. for 15 hours to obtain photoconductive fine powder of $CdS_{0.7}Se_{0.3}.nCdCO_3$. This fine powder is then dispersed along with a thermosetting acyl resin (Acrydic A405 available from Dainippon Ink Co.) and xylene solution and then coated onto an aluminum drum of 120 mm in diameter by spraying to provide a thickness of about 30 microns and subsequently heat cured. Over this photoconductive layer, a solution containing xylene and thermosetting acryl resin was then coated into a thickness of about 1 micron to form an insulating protective layer.

Various tests were conducted using these photosensitive members A, B and C as the photosensitive drum 1 of the apparatus shown in FIG. 3. The results are as follows.

Figure 2:
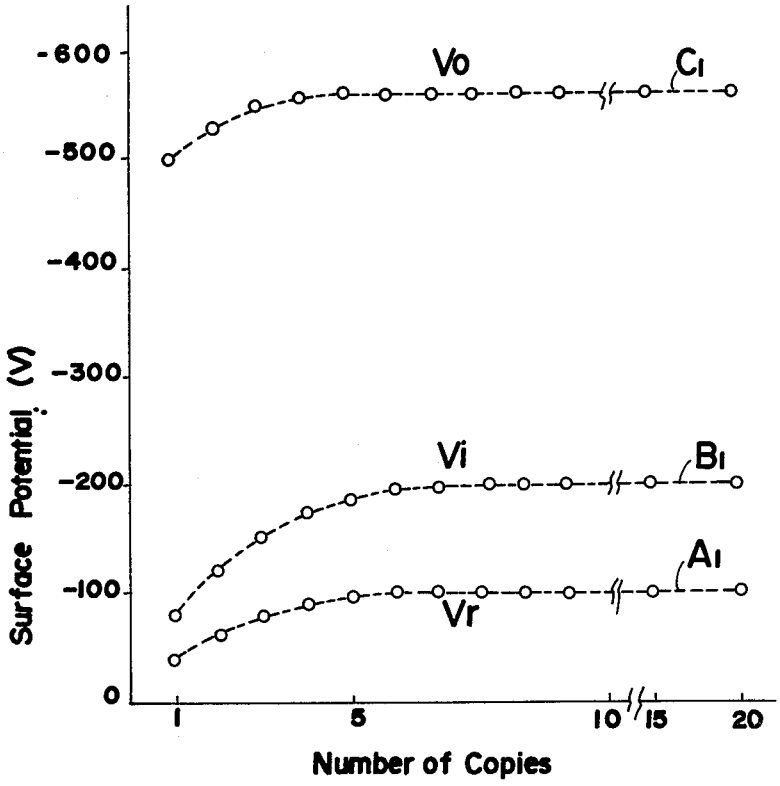
FIG. 2 is a graph showing changes in surface and residual potentials of the photosensitive member shown in FIG. 1 when the same is subjected to continuous copying by a conventional image forming method.

Prior to discussion of experimental results obtained by the copying method according to the present invention, the occurrence of the phenomenon of photosensitivity variations after a cessation will be described with reference to FIG. 2 by the use of the photosensitive member B with the protective layer and by subjecting the same to a conventional copying method shown in FIG. 5 to U.S. Pat. No. 4,175,955. In other words, transfer charger 8 and sub-charger 13 in FIG. 3 were kept deenergized and the photosensitive member B in a form of drum 1 was subjected to the process of high illumination erasing of 2000 lux.sec by the eraser 14, charging by the main corona charger 2 and an image exposure by the lamp 4 for 20 continuous copies after a long time cessation at which time the residual potential was 0 volt. In FIG. 2, curve $A_1$ designates the residual potential Vr after the high illumination erasing by the eraser 12, curve $B_1$ the light decayed voltage Vi after the image exposure which corresponds to light exposed portion of photosensitive member, and curve $C_1$ the surface potential $V_0$ by the charger 2 which corresponds to the non-exposed portion of photosensitive member. As more copies are made, space charges (residual charges) are gradually accumulated in the boundary between the protective layer and photoconductive layer to cause a gradual increase in residual potential Vr and will be as large as about −100 volts at its equilibrium value. (It should be noted that residual potential Vr for the photosensitive member without the insulating protective layer will be only about −20 volts or less.) The increase of Vr will similarly cause increases in $V_0$ and Vi to reduce the photosensitivity. Residual potential Vr after a cessation of sufficiently long time will become 0 volt again as space charges are gradually discharged during the cessation indicating that the phenomenon of photosensitivity variations after a cessation is reproducible.

FIGS. 9 to 13 respectively show the degree of sensitization by photosensitive members A, B and C by the copying method of the present invention as compared with the conventional copying method discussed above. The conventional copying method or the high-illumination erasing system discussed herein refers to the copying method disclosed in connection with FIG. 5 to U.S. Pat. No. 4,175,995 and in particular, the copying method with no steps through the transfer charger 8 and the sensitizing unit 12 which consists of the sub-charger 13 and the eraser 14 but only through the eraser 14 with its amount of exposure in the order of a couple to several thousands lux.sec in the apparatus shown in FIG. 3 herein.

Figure 9:
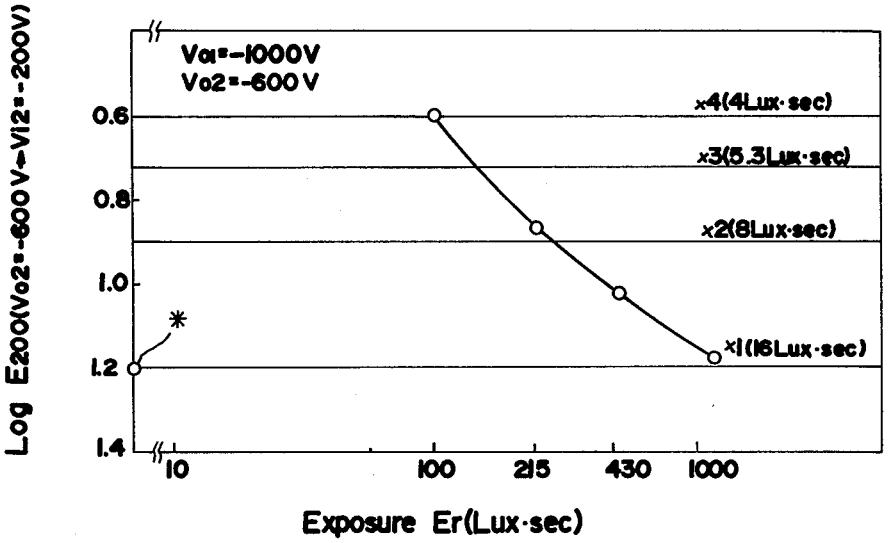
FIGS. 9 and 10 are graphs showing increase in photosensitivity of the photosensitive member and particularly showing respectively the dependency of photosensitivity relative to an amount of exposure by a light eraser when $CdS.nCdCO_3$ ($0<n\leqq 4$) is used as a photoconductive material in the photosensitive member.

FIG. 9 shows the dependence of the photosensitivity of photosensitive member A (expressed in terms of the amount of exposure logarithm E200 required for reducing $V_{02}$ (−600 volts) to $Vi_2$ (−200 volts)) on the amount of erasing exposure, Er, applied by the eraser 14 when the surface potential $V_{01}$ applied to the sub-charger 13 is −1000 volts. The photosensitivity is plotted as the ordinate vs. the amount of erasing exposure as the abscissa. The mark * in FIG. 9 indicates the sensitivity, 16 lux.sec, afforded by the high-illumination erasing system to the photosensitive member shown in FIG. 5 of U.S. Pat. No. 4,175,955 and the case where the amount of exposure Er by the eraser was set to equal to 2000 lux.sec with $V_{00}$ and $V_{01}$ respectively zero. This sensitivity of 16 lux.sec is taken as the standard (1 time or X1) for comparison purpose.

The drawing reveals that the smaller the amount of sub-erasing exposure, Er, the higher is the sensitivity, indicating a peak value of about four-fold (X4) the standard in case of $V_{01}$ equal to −1000 volts and Er equal to 100 lux.sec. Even with the exposure amount of Er of 215 lux.sec, the photosensitive member A is sensitized more than twice (X2) the standard. Similarly, sensitization of more than 1.5-fold the standard is observed for the case of Er equal to about 430 lux.sec. Thus for the case of four-fold sensitization (Er=100 lux.sec), the amount of exposure E200 required to decay $V_{02}$ (−600 V) to $Vi_2$ (−200 V) is only about 4 lux.sec as compared with 16 lux.sec necessary in the conventional method. In the region of smaller amounts of exposure Er on the left side of the peak, the sensitivity falls towards the left although not shown; $Vi_1$ (the surface potential after erasing illumination) becomes larger than −100 V and undergoes greater variations during repeated cycles (gradually increases to give gradually decreasing sensitivity), so that $V_{02}$ (surface potential after charging by the main charger) becomes unstable, hence objectionable in practice. Accordingly the region shown in FIG. 9 in which the sensitivity falls toward the right from the peak is usable for practice.

Figure 10:
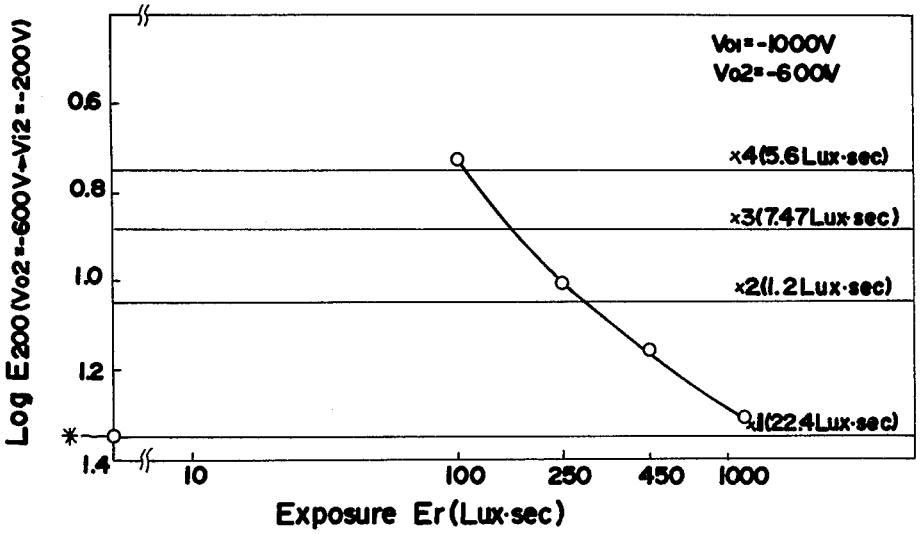

FIG. 10 is similar to FIG. 9 and shows the dependence of photosensitivity E200 of photosensitive member B on the amount of erasing exposure, Er, applied by the eraser 14 when the surface potential $V_{01}$ applied by the sub-charger 13 is −1000 V. It should be noted that the photosensitivity is expressed in terms of the logarithm of the amount of exposure, E 200, required to decay $V_{02}$ of −600 V to $Vi_2$ of −200 V. The mark * indicates the amount of exposure of 22.4 lux.sec necessary by the conventional copying method and this will be taken as the reference sensitivity (1 time or X1). It is noted that the amount of exposure by the eraser 14 was set equal to 2000 lux.sec in the case of the reference sensitivity.

The results are similar and reveal that the smaller the amount of erasing exposure, Er, the higher is the sensitivity, indicating a peak value of about four-fold (X4) the reference when Er equals 100 lux.sec. Even with Er increased to 250 lux.sec, photosensitive member B is sensitized twice as much. It will be noted that the region shown in FIG. 10 in which the sensitivity falls toward the right from the peak is usable for actual practice for the same reason discussed in connection with FIG. 9.

Figure 11:
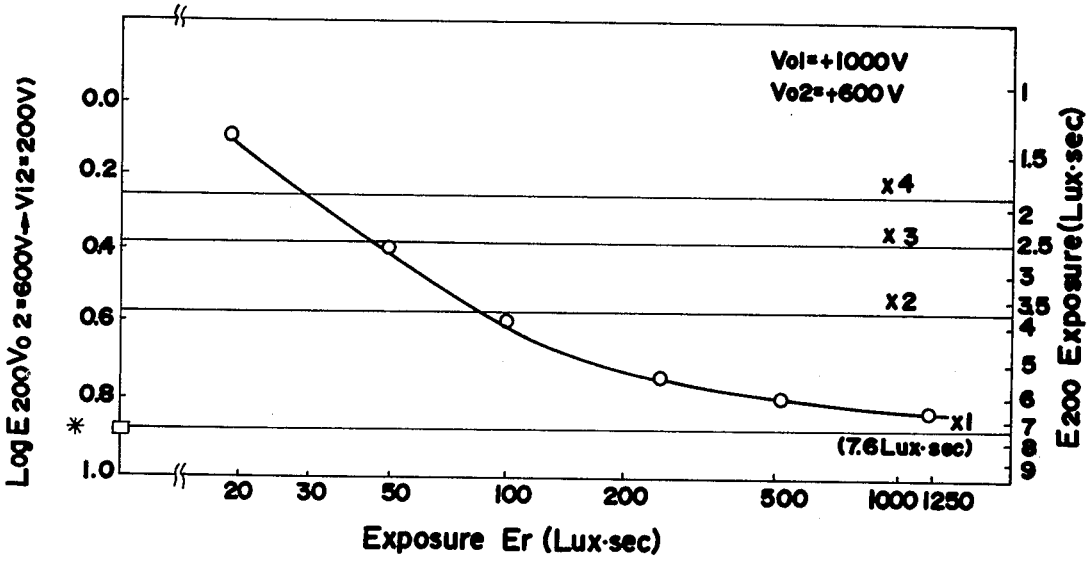
FIGS. 11 to 13 are graphs similar to those shown in FIGS. 9 to 10 and showing respectively the dependency of photosensitivity of the photosensitive member relative to an amount of exposure by a light eraser when $CdS_{0.7}Se_{0.3}.nCdCO_3$ ($0<n\leqq 4$) is used as a photoconductive material in the photosensitive member.

Using photosensitive member C which includes $CdS_{0.7}Se_{0.3}.nCdCO_3$ as the photoconductive material, similar experiments were conducted for the cases of positive charging as well as negative charging. FIG. 11 shows the degree of sensitization of photosensitive member C when the charging polarities in the pre-hysteresis sensitization step and the electrostatic latent image forming step are all set to positive polarities. The photosensitivity is expressed in terms of the amount of exposure E200 and the logarithm log E200 required for decaying $V_{02}$ of +600 V to $Vi_2$ of 200 V. Photosensitivity E200 of this photosensitive member C by the copying method with no processes through the transfer charger 8 and the sensitizing unit 12 but with the high illumination exposure amount of about 5000 lux.sec by the eraser 12 was about 7.6 lux.sec and this will be taken as the reference sensitivity (1 time or X1). With $V_{01}$ of 1000 V, the results indicate that the smaller the amount of erasing exposure, Er, the higher is the sensitivity, indicating 1.2-fold sensitization with Er of 1250 lux.sec, nearly twofold with Er of 100 lux.sec, threshold with Er of 50 lux.sec and more than fourfold with Er of 20 lux.sec. Since the surface potential, $V_{02}$, tends to decrease and will not be as high as 600 V in the case of Er equal to 20 lux.sec, it is best to set Er greater than 50 lux.sec. In other words, the region shown in FIG. 11 in which the sensitivity falls toward the right from the threefold sensitization where Er equals 50 lux.sec is usable for practice.

Figure 12:
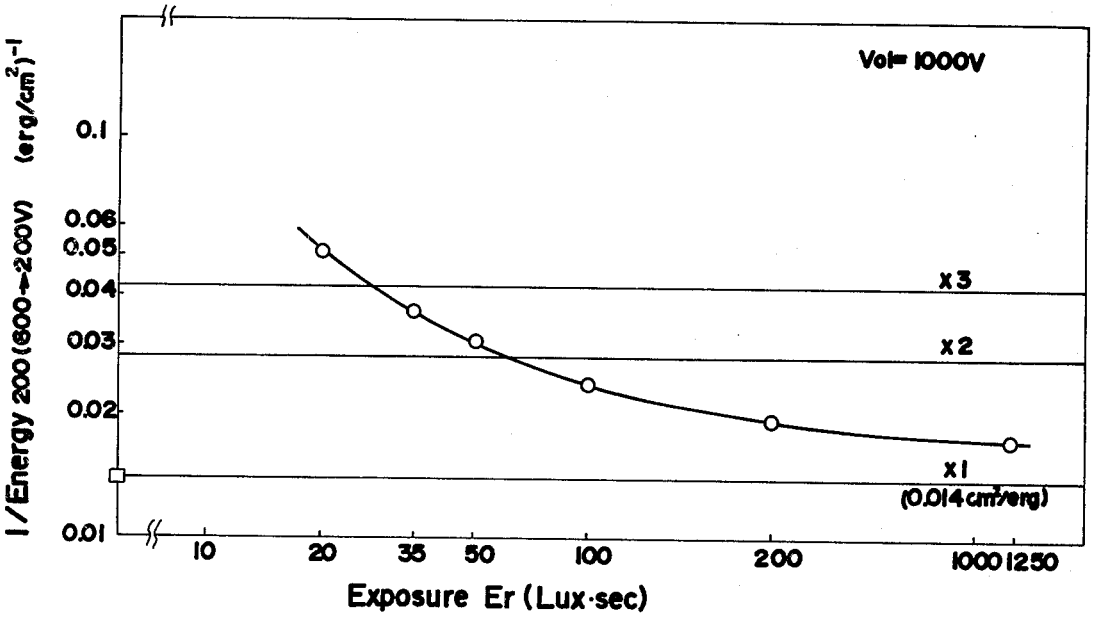

FIG. 12 is basically similar to FIG. 11 and shows the degree of sensitization of photosensitive member C with monochromatic light of wavelength of 7600 Å as the source of image exposure so as to determine the applicability of the copying method of the present invention to the semiconductor laser beam printer shown in FIG. 8. In conducting the experiment, surface potential $V_{01}$ by the sub-charger 13 was set to equal to 1000 V. For the conventional copying method, the exposure amount by the eraser was set to equal to 5000 lux.sec. In the drawing, a curve designates the reciprocal of the energy, 1/Energy 200, required to decay the surface potential $V_{02}$ of 600 V by the main corona charger 2 to $Vi_2$ of 200 V in accordance with the amount of exposure by the eraser 14. The sensitivity of photosensitive member C by the conventional copying method was 0.014 $(erg/cm^2)^{-1}$ and this will be taken as the standrad (X1).

The results indicate that the smaller the amount of erasing exposure, Er, the higher is the sensitivity, showing a peak value of more than three-fold the standard. Accordingly, the copying method according to the present invention is quite effective for the semiconductor laser beam printer which necessitates high copying speed at high sensitivity.

Figure 13:
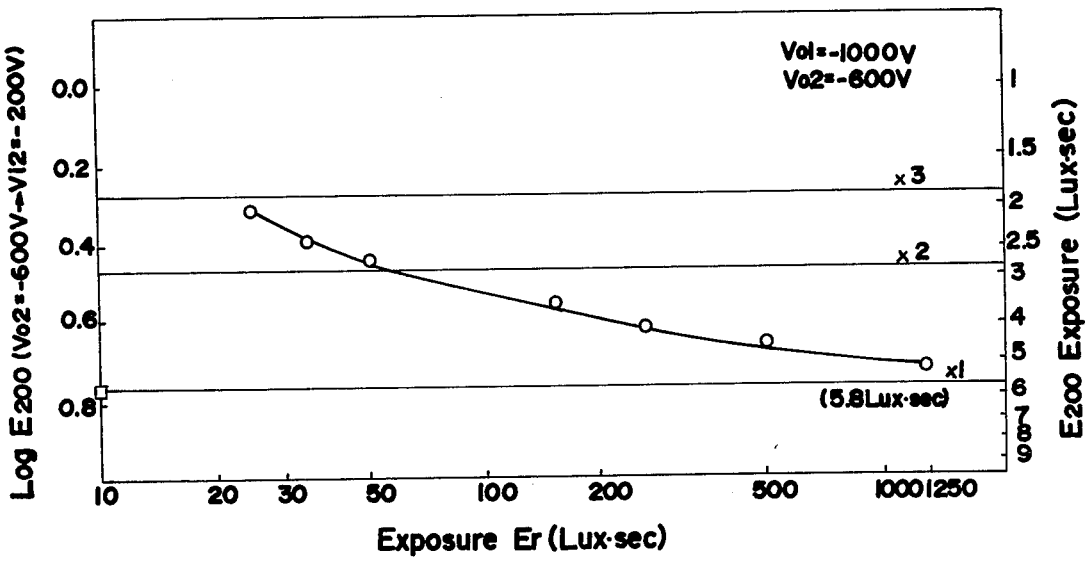

FIG. 13 shows the degree of sensitization for photosensitive member C in case of setting a negative charging polarity in the pre-hysteresis sensitization step and the latent image forming step. With $V_{01}$ equal to $-1000$ V and the photosensitivity taken as the amounts of exposure required to decay $V_{02}$ of $-600$ V to $Vi_2$ of $-200$ V, the results obtained indicated the process-wise sensitization of more than twofold the standard (which requires the image exposure amount of 5.8 lux.sec as shown by *mark) with the amount of exposure Er of less than 50 lux.sec. In other words, the amount of image exposure, E200, of only less than 2.9 lux.sec is needed to decay $V_{02}$ of $-600$ V to $Vi_2$ of $-200$ V as long as the amount of exposure by the eraser 14 is in the range of 25 to 50 lux.sec. Even with Er as high as 500 lux.sec, the degree of sensitization is nearly 1.5-fold standard. It is noted that the amount of exposure, Er, by the eraser 14 be preferably greater than 40 to 50 lux.sec since the surface potential, $V_{02}$, will not be as high as $-600$ V when Er equals to 25 lux.sec. Thus, the region towards the right from the twofold sensitization where Er equals about 50 lux.sec is usable.

While there have been described and shown in FIGS. 9 to 13 the dependencies of photosensitivites of photosensitive members A, B and C the degree of sensitization will vary considerably depending on the manufacturing process used to form the photosensitive member, the type of resin binder used in the photoconductive layer 1*b* and the amount of impurity such as copper included in the photoconductive layer. This is to say that the degree of sensitization will vary particularly in the region where the amounts of exposure Er are relatively large although it is substantially the same in the region where sensitization is a maximum. In other words the maximum degree of sensitization shown in FIGS. 9 to 13 for each photosensitive members A, B and C would be substantially the same regardless of the manufacturing process or the type of resin binder used. However, their absolute sensitivities, i.e., minimum sensitivities will vary and sensitization curves shown may either have more slanted or less slanted slopes although the maximum degrees of sensitization are substantially same. For the same reason, standard sensitivities indicated by marks * will also vary depending on the manufacturing process and the type of resin binder used.

Figure 14:
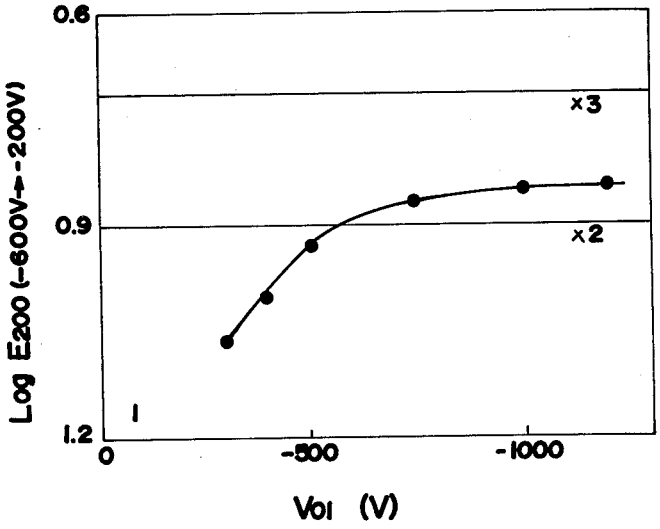
FIGS. 14 to 17 are graphs each showing the dependency of the photosensitivity of the photosensitive member relative to a surface potential charged by a sub-charger, wherein results shown in FIGS. 14 and 15 were obtained from photosensitive members using $CdS.nCdCO_3$ as photoconductive material and results in FIGS. 16 and 17 from photosensitive members using $CdS_{0.7}Se_{0.3}.nCdCO_3$ as the photoconductive material.
Figure 17:
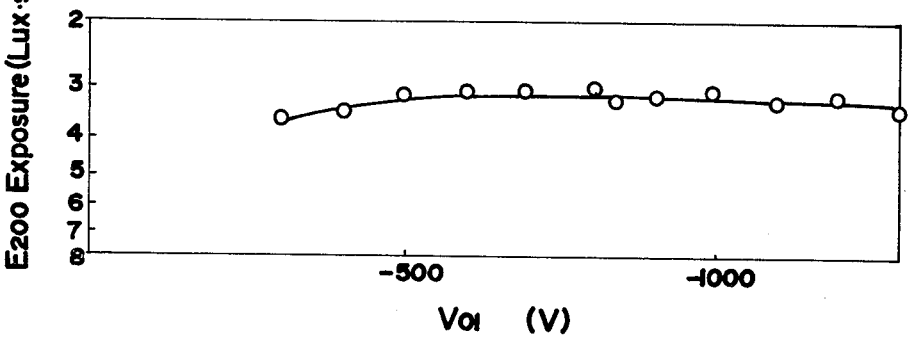

FIGS. 14 and 17 show the dependencies of photosensitivities of respective photosensitive members A, B and C on the surface potentials $V_{01}$ by the sub-charger 13 when Er is set to a constant amount.

Specifically, FIG. 14 shows the dependence of the photosensitivity, log E200, of photosensitive member A on $V_{01}$ as FIG. 9 is seen along a vertical line, namely at a constant amount of 250 lux.sec of erasing exposure Er. With $V_{02}$ set to $-600$ V, the drawing reveals that in the region where the $V_{01}$ value is larger than about $-600$ V, the sensitivity tends to level off and is not dependent largely on the $V_{01}$. FIG. 14 shows that in this region the sensitivity is dependent chiefly on the amount of erasing exposure Er, indicating that the degree of sensitization saturates in the region where the pre-hysteresis charge potential by the sub-charger 13 is sufficiently high and its saturation value or the degree of sensitization is adjustable by the amount of Er over a wide range.

Figure 15:
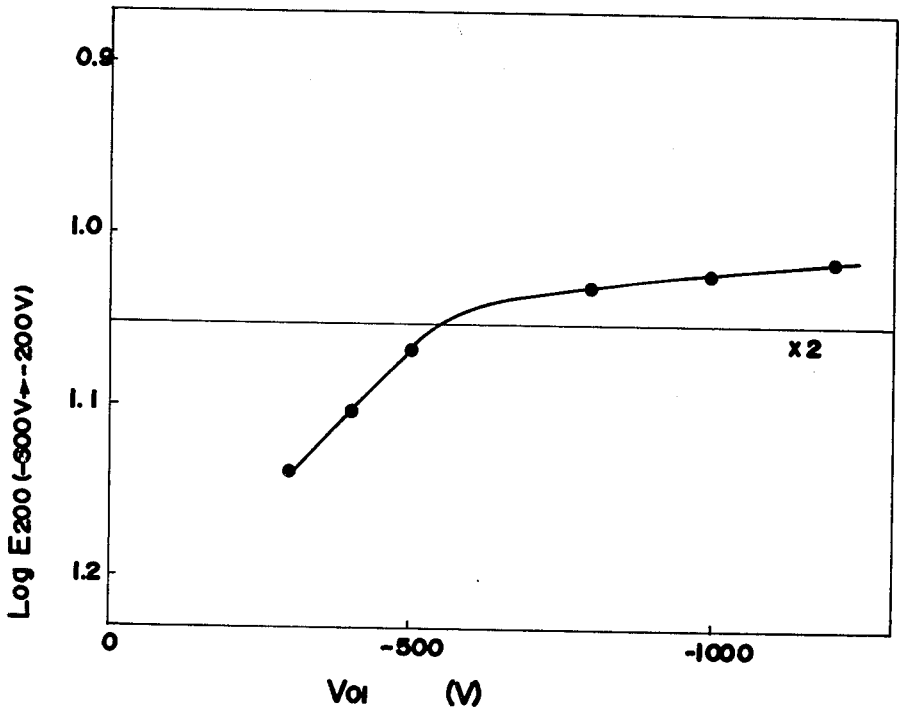

Similarly, for the photosensitive member B but with the conditions of $V_{02}=-600$ V, Er=250 lux.sec and the photosensitivity expressed in term of log E200, the results show that the sensitivity E200 levels off when $V_{01}$ is greater than $-600$ V as shown in FIG. 15 indicating that the photosensitivity is chiefly dependent on the amount of erasing exposure Er as long as $V_{01}$ by the sub-charger 13 is greater than about $-600$ V.

Figure 16:
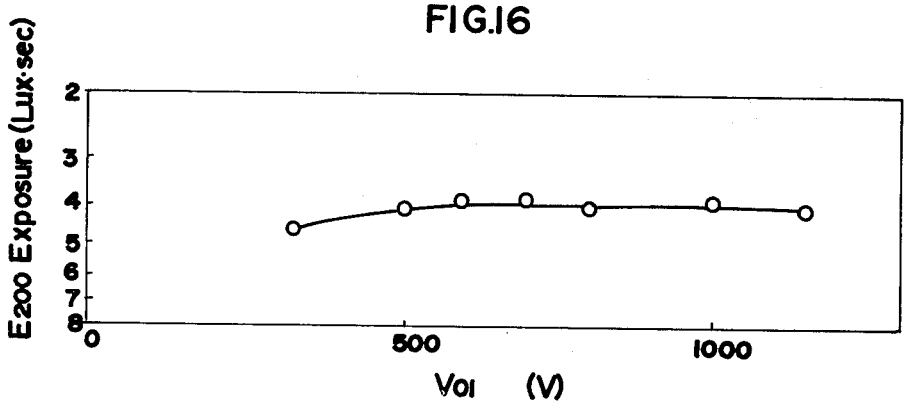

With the use of photosensitive member C under the conditions of positive charging polarities and $V_{02}$ of 600 V and Er of 100 lux.sec, the photosensitivity E200 tends to level off with the surface poetntial $V_{01}$ greater than $+500$ V as shown in FIG. 16. Similarly, under the negative chargings, the sensitivity E200 showed the saturation tendency with $V_{01}$ of greater than $-500$ V as shown in FIG. 17. Thus, the degree of photosensitivity chiefly depends on the amount of Er as long as $V_{01}$ is greater than $+500$ V or $-500$ V indicating that the increase in the sensitivity is adjustable by the amount of Er by the sub-eraser 14 over a wide range. Since the amount of exposure, Er, by the eraser 14 directly influences the degree of sensitization, it is important to take some measures to prevent uneven exposure by the eraser 14 as it results in unevenness in the density of the copy obtained.

Discussion will now be directed to the dependence of the front half fogging and sensitivity variations after a cessation, respectively, on the amount of exposure, Er, by the eraser 14 in the pe-hysteresis sensitization step for each photosensitive members A, B and C. Unless otherwise stated, the experiments therefor were conducted under the conditions of $V_{00}$ by the transfer charger 8 to equal $-650$ V for photosensitive members A and B, $\pm 400$ V for photosensitive member C with no copying paper present and with the other chargers deenergized, $V_{01}$ by the sub-charger 13 only equal to $-700$ V for photosensitive member A and B and $\pm 1000$ V for C and $V_{02}$ by the main corona charger 2 only equal to $-600$ V for A and B and $\pm 600$ V for C.

Figure 18:
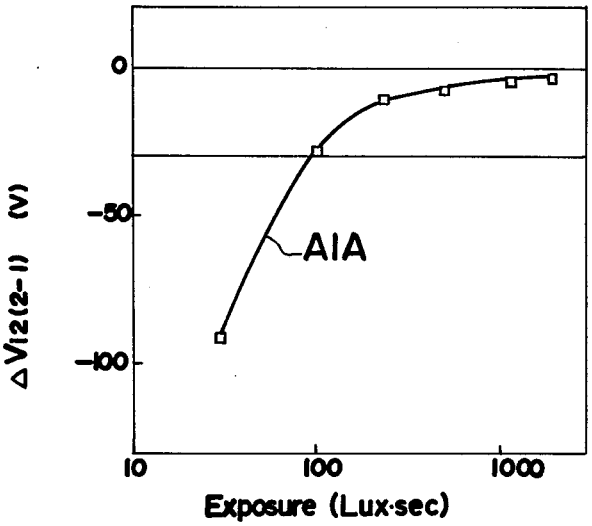
FIGS. 18 and 19 are graphs indicative of front half and latter half fogging phenomena and respectively showing the relation between an amount of exposure by an eraser in the first sensitization step and the difference in surface potentials after optical image exposure in the first and second rotations of the photosensitive member using $CdS.nCdCO_3$ as the photoconductive material.

FIGS. 18 to 21 show the relation between the amount of erasing exposure Er and the difference in surface potentials $\Delta Vi_2$ obtained by subtraction of $Vi_2$ after image exposure in the first rotation of photosensitive member from $Vi_2$ in the second rotation after a sufficiently long cessation for photosensitive members A, B and C. The drawings therefore are indicative of behavior on the first drum rotation effect (FDRE) showing the relation between Er and front half fogging. In FIG. 18 for photosensitive member A, a curve AlA indicates that when the amount of erasing exposure, Er, is as small as 30 lux.sec, $\Delta Vi_2$ becomes as high as $-100$ V to cause the front half fogging on the copy to be obtained. On the other hand, fogging diminishes remarkably with an increase in the intensity of erasing illumination Er and with Er of 100 lux.sec, $\Delta Vi_2$ becomes about $-30$ V and with Er of 1000 lux.sec, $\Delta Vi_2$ is nearly 0 V.

The value $\Delta Vi_2$ indicative of front half fogging need not always be zero V but may be up to about $-50$ V, preferably less than $-30$ V. If $\Delta Vi_2$ is not greater than $-50$ V, no problem will arise in practice since the copies then obtained are almost free of density differences. Thus, in the case of photosensitive member A, Er may be as low as about 70 lux.sec, preferably more than 100 lux.sec and as high as 1000 lux.sec or more.

Figure 19:
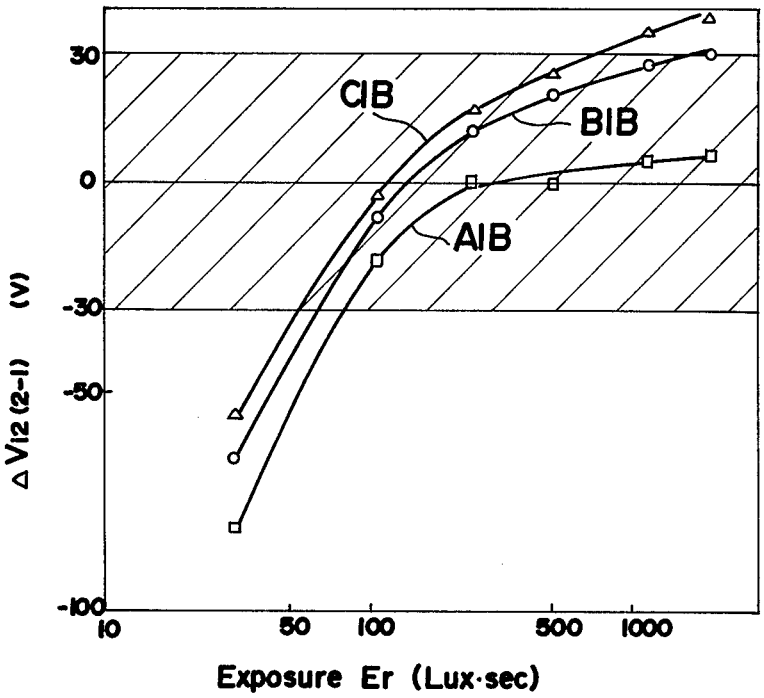

In FIG. 19 for photosentitive member B, curves AlB BlB and ClB represent the characteristics of the first drum rotation effects after a cessation of 30 seconds, 3 minutes and 10 minutes respectively following the termination of continuous copying operation. In each cases, there is substantially the same tendency likely to cause front half fogging since $\Delta Vi_2$ becomes excessively negative in its potential when the amount of erasing exposure, Er, is set small, e.g., when Er equals 30 lux.sec. Contrary to this, the potential difference, $\Delta Vi_2$, becomes positive when the amount of erasing exposure Er exceeds 200 lux.sec and this will likely cause the latter half fogging. The phenomenon of potential difference $\Delta Vi_2$ to become positive is inherent only in the photosensitive member with the insulating protective layer such as B and C and not observed in the photosensitive member A without the protective layer. In other words, provided that a length of an image to be formed is longer than the circumferential length of drum, the sensitivity of photosensitive member on a portion corresponding to the second rotation is lower than the first rotation for the first copy after a sufficiently long cessation and when this effect exceeds the front half fogging effect based on the degree of trap filling, $\Delta Vi_2$ becomes larger than zero V on the positive side to more likely cause the latter half fogging. At any rate, the amount of erasing exposure Er must not be excessively large or small but within a suitable range in order to prevent image noises resulting from front and latter halve foggings. Since $\Delta Vi_2$ may be as large as $\pm 50$ V, preferably less than $\pm 30$ V without causing density differences, the shaded area in FIG. 19 or more particularly, the range of about 50 to 1000 lux.sec for Er is preferable.

Figure 20:
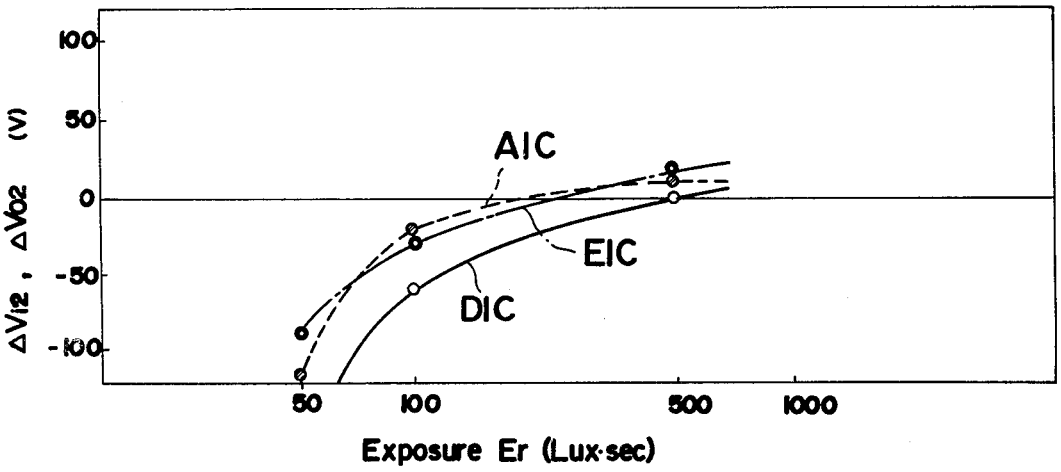
FIGS. 20 and 21 are graphs indicative of front half and latter half fogging phenomena and of sensitivity variations after a cessation and respectively showing the relation between an amount of exposure by a light eraser and the difference in surface potentials of the photosensitive member using $CdS_{0.7}Se_{0.3}.nCdCO_3$ as the photoconductive material.
Figure 21:
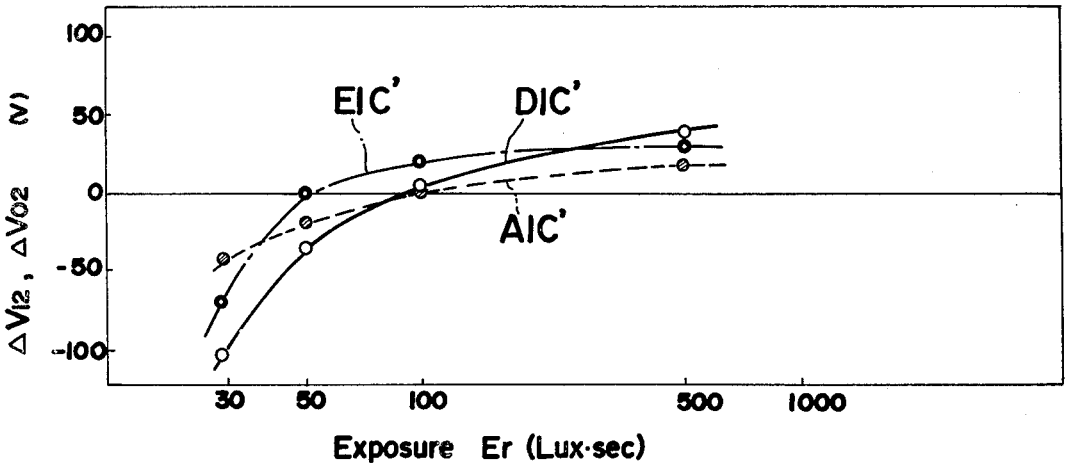

Curves AlC and AlC' shown in FIGS. 20 and 21 are similar to those of FIGS. 18 and 19 and represent the relation between $\Delta Vi_2$ and Er for photosensitive member C. In the case of positive chargings as shown in FIG. 20, it is seen that $\Delta Vi_2$ will become zero volt by setting the amount of erasing exposure equal to about 200 lux.sec and to about 100 lux.sec in the case of negative chargings (curve AlC' in FIG. 21) so that neither front half fogging nor latter half fogging will occur. In addition, each curve shows the tendency of $\Delta Vi_2$ to become large as the amount of erasing exposure, Er, becomes small and the higher the sensitization is, $\Delta Vi_2$ becomes larger on the negative potential side with the decrease of Er thereby showing the tendency to cause front half fogging. For example, $\Delta Vi_2$ becomes as large as $-100$ V in the case of positive chargings and as large as $-20$ V in the case of negative chargings when the amount of erasing exposure, Er, equals 50 lux.sec (which corresponds to threefold sensitization in the case of positive chargings and to 2.2-fold sensitization in the case of negative chargings). On the other hand, each curve exhibits the saturation tendency with $\Delta Vi_2$ of less than $\pm 30$ V when the amount of erasing exposure Er exceeds 500 lux.sec (not shown) so that latter half fogging is effectively prevented. Since the density differences on a copy are hardly noticeable when $\Delta Vi_2$ is less than $\pm 50$ V or preferably less than $\pm 30$ V, the amounts of erasing exposure Er for photosensitive member C should be more than about 70 lux.sec in the case of positive chargings and more than 30 lux.sec, preferably more than 50 lux.sec since $V_{02}$ is unstable with Er of less than 50 lux.sec in the case of negative chargings. These lower limit values are subject to change by the characteristics of the sensitivity variations after a cessation which will be explained hereinbelow. The upper limit value of Er may be as high as 1000 to 1500 lux.sec since each curve saturates with Er of greater than 500 lux.sec.

Prevention of staining of images will be considered again with references to FIGS. 14 to 17. Since the degree of sensitization is not dependent on the surface potential at high $V_{01}$ values ($-600$ V for photosensitive members A and B and $\pm 500$ V for C), it is effective to set $V_{01}$ at a sufficiently high level almost equal to 1000 V for the prevention of image staining due to local unevenness of the surface potential in the latent image forming or transfer step (especially due to a difference in the surface potential, resulting from the use of a copy sheet of small width, between a location where the sheet is passed and a location where it is not passed).

Furthermore, although the surface potential $V_{01}$ by the sub-charger 13 alone is set sufficiently high to saturate the degree of sensitization, it is desirable to energize the transfer charger 8 from the first rotation of the drum since this will make $V_{01}$ even higher to effectively prevent the staining of images.

FIGS. 22, 23 and 20 to 21 respectively show the behavior or phenomenon of sensitivity variations after a cessation for photosensitive members A, B and C.

Figure 22:
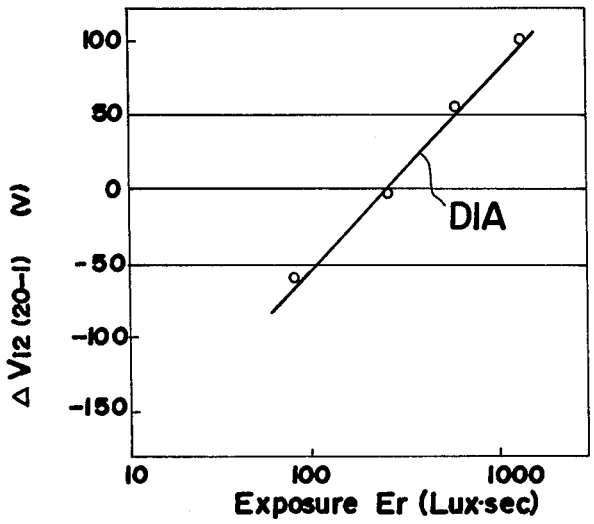
FIGS. 22 and 23 are graphs indicative of sensitivity variations after a cessation and respectively showing the relation between an amount of exposure by a light eraser and the difference in surface potentials after optical image exposure in the first and twentieth rotations of the photosensitive member using $CdS.nCdCO_3$ as the photoconductive material.

FIG. 22 shows the relation determined during a continuous copying operation following a cessation of a sufficient period of time, between the amount of erasing exposure Er and the $Vi_2$ value for making the twentieth copy minus the $Vi_2$ value for making the first copy, namely, $\Delta Vi_2$, for photosensitive member A. In the drawing, a curve DlA shows the decrease of sensitivity as $\Delta Vi_2$ becomes $+100$ V or so at the excessive amount of erasing exposure of more than 1000 lux.sec. But, $\Delta Vi_2$ becomes sufficiently small, i.e., less than $\pm 50$ V as the amount of erasing exposure, Er, is decreased unless Er is excessively decreased which in turn causes the undesirable increase in photosensitivity. For this reason, it is important to set the amount of erasing exposure, Er, by the eraser 14 to a suitable range which is not excessively large or small. Since the density differences between each copy are hardly noticeable with $\Delta Vi_2$ of less than $\pm 50$ V, the amounts of exposure, Er, should be about 100 to 700 lux.sec for photosensitive member A.

Figure 23:
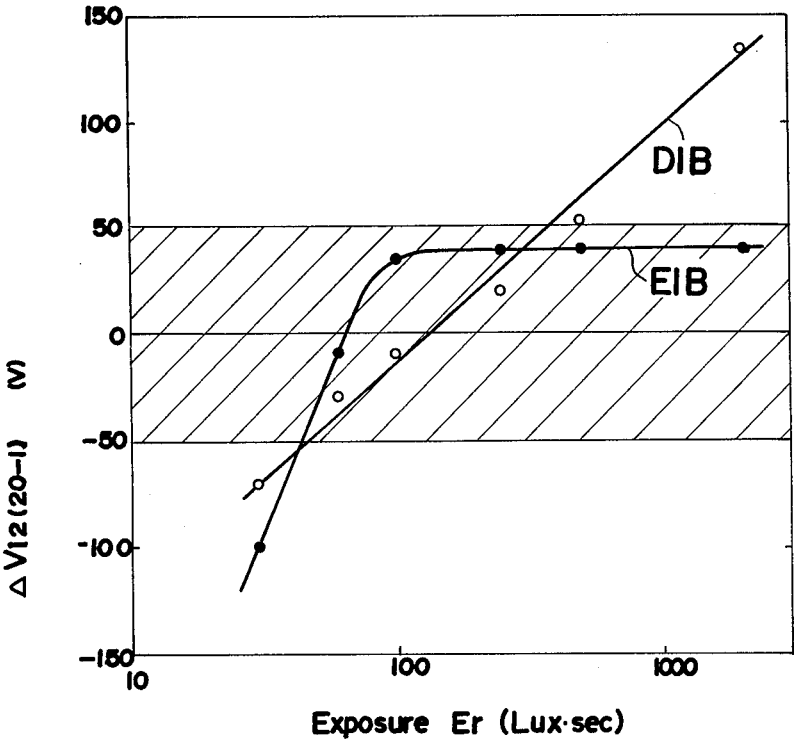

FIG. 23 is similar to FIG. 22 and shows the relation between the amount of erasing exposure Er and the potential difference of $\Delta Vi_2$ obtained by subtracting $Vi_2$ in the first copy from $Vi_2$ in the twentieth copy in a continuous copying operation following a cessation of a sufficient period of time for photosensitive member B. In addition, this figure shows the relation between the amount of erasing exposure Er and the potential difference of $\Delta V_{02}$ obtained by subtracting surface potential $V_{02}$ charged by the main charger 2 in the variations after a cessation. In the drawings, the curves DlC and DlC' respectively represent the relation between Er and $\Delta Vi_2$ for positive and negative chargings and the curves ElC and ElC' the relation between Er and $\Delta V_{02}$ for positive and negative chargings. As can be understood, image density differences resulting from the sensitivity variations after the cessation are effectively prevented by setting the amount of erasing exposure Er equal to about 500 lux.sec in the case of positive chargings and equal to about 100 lux.sec in the case of negative chargings for $\Delta Vi_2$ to become 0 V. Furthermore, for $\Delta V_{02}$ to become 0 V, Er should equal about 250 lux.sec in the case of positive chargings and equal to about 50 lux.sec in the case of negative charging. Observing the overall characteristics of curves DlC, DlC', ElC and ElC', it is seen that the higher the degree of sensitization is, i.e., the smaller the amount of erasing exposure, the greater will be values of $\Delta Vi_2$ and $\Delta V_{02}$ be on the negative side. For example, $\Delta Vi_2$ becomes greater than $-50$ V with Er of less than 100 lux.sec in the case of positive chargings and with Er of less than about 30 to 40 lux.sec, both $\Delta Vi_2$ and $\Delta V_{02}$ become greater than $-50$ V to bring about undesirable increase in the sensitivity. On the other hand, both $\Delta Vi_2$ and $\Delta V_{02}$ level off at values of $+40$ V with Er of greater than 500 lux.sec. From the foregoing discussion and since $\Delta Vi_2$ and $\Delta V_{02}$ may be as high as $\pm 50$ V without causing noticeable image density differences, the amounts of erasing exposure Er for preventing first copy from $V_{02}$ in the twentieth copy. Curve DlB and ElB respectively represent the dependences of $\Delta Vi_2$ and $\Delta V_{02}$ on Er and as may be seen, the image density differences resulting from the sensitivity variations after the cessation are effectively prevented by setting the amounts of erasing exposure Er equal to about 150 lux.sec for $\Delta Vi_2$ to become 0 V and equal to about 60 lux.sec for $\Delta V_{02}$ to become 0 V. While the potential difference of $\Delta V_{02}$ represented by the curve ElB levels off at a value of $+40$ V with the amounts of erasing exposure greater than about 100 lux.sec, it sharply decreases to induce an undesirable increase in the sensitivity by setting Er excessively small. On the other hand, it is seen that the potential difference of $\Delta Vi_2$ (curve DlB) becomes large on the positive side by increasing Er excessively and large on the negative side by decreasing Er excessively. Since the density differences between each copy are hardly noticeable if $\Delta Vi_2$ and $\Delta V_{02}$ are less than $\pm 50$ V (shaded area of FIG. 23), the amounts of erasing exposure Er suitable for preventing the sensitivity variations after a cessation for photosensitive member B should be about 50 to 400 lux.sec.

Referring now to FIGS. 20 and 21 concerned with photosensitive member C, curves DlC and DlC' as well as curves ElC and ElC' respectively represent the relation between the amount of erasing exposure Er and the potential differences of $\Delta Vi_2$ and $\Delta V_{02}$ from the first to twentieth copy for both the positive and negative chargings and are indicative of the sensitivity image density differences resulting from the sensitivity variations after a cessation for photosensitive member C should be about 100 to 1500 lux.sec in the case of positive chargings and about 50 to 1500 lux.sec in the case of negative chargings.

Figure 24:
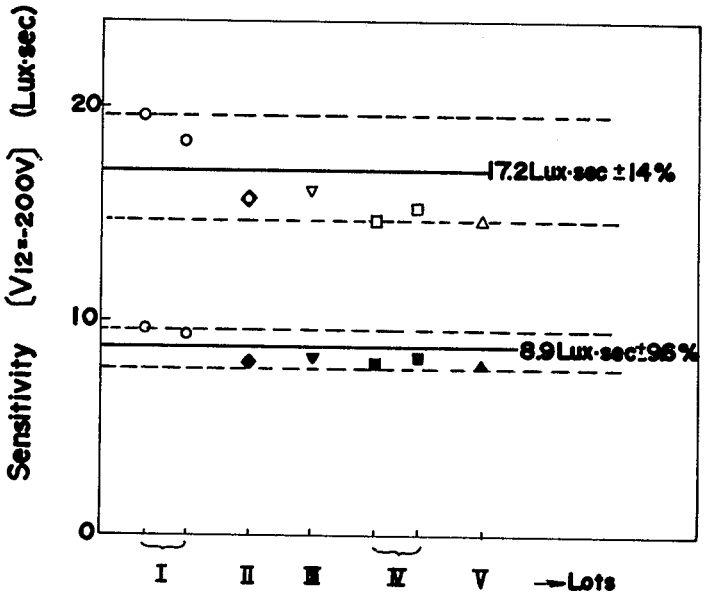
FIG. 24 is a graph showing sensitivity variations of a number of the same photosensitive members manufactured.

Using various photosensitive members B prepared by the same manufacturing method and taken from different manufacturing lots I to V, the experiments were conducted to determine the sensitivity variations among these members under the fixed conditions of $V_{01}=-1000$ V, $V_{02}=-600$ V and Er=250 lux.sec (which corresponds to twofold sensitization) by the copying method according to the present invention and under the conditions of $V_{01}=0$ V, $V_{02}=-600$ V and Er=2500 lux.sec by the conventional copying method. The results are shown in FIG. 24 and as may be seen by the filled in marks, the central value of the amount of image exposure needed to decay $V_{02}$ of $-600$ V to $Vi_2$ $-200$ V between the largest and the smallest was 8.9 lux.sec by the present invention and the sensitivity variations were only about $\pm 9.6\%$ from its central value. Contrary to this, the sensitivity variations from the central value of 17.2 lux.sec were as large as $\pm 14\%$ by the conventional copying method as shown by the unfilled marks. This means that the sensitivity variations are reduced by more than 30% by the copying method of the present invention and gives drums a greatly increased latitude in the variations of the characteristics thereof.

In a running test for photosensitive member B conducted using the apparatus shown in FIG. 3 and in which 10,000 copies were made under the twofold sensitizing condition, the drum substantially retained the initial light decay characteristics until the last copy and in addition, no damages to the surface of drum and the elastic blade were observed.

As may be apparent from the description in connection with FIGS. 9 to 13, the degree of sensitization of photosensitive members useful in the present invention chiefly depends on the amount of erasing exposure Er by eraser 14 in the region of sufficiently high pre-hysteresis charge potential and in principle, the sensitization increases as the amount of Er becomes small. For example, twofold sensitization is achieved processwise with an Er of 215 lux.sec and fourfold with an Er of 100 lux.sec for photosensitive member A. Accordingly, any one of the photosensitive members is sensitized processwise from one time over to several times by the present invention. However, it is preferable to set the amount of Er to achieve at least 1.5-fold sensitization in order to attain the essential effects of the present invention. Moreover, the amount of erasing exposure Er must be chosen to avoid stains on images and image density differences resulting from the front half and latter half foggings, the memory phenomenon and the sensitivity variations after a cessation. Taking all these and other factors into consideration, the amount of erasing exposure Er by the eraser 14 suitable for the present invention should be about 100 to 500 lux.sec for photosensitive member A, 100 to 400 lux.sec for photosensitive member B and 100 to 500 lux.sec in the case of positive chargings and 50 to 500 lux.sec in the case of negative chargings for photosensitive member C. It should be noted that these values as well as other values mentioned in connection with the copying method of the present invention will vary somewhat depending on a measuring device used to measure an exposure amount, on the type of light source and color temperature therefor and on other various factors and will often contain errors of up to 50%. Thus, upper and lower limit values will have ranges of up to $\pm 50\%$ at maximum so that the amount of erasing exposure Er may be as low as 50 lux.sec and as high as 750 lux.sec for photosensitive member A, 50 to 600 lux.sec for photosensitive member B and 50 to 750 lux.sec in the case of positive chargings and 25 to 750 lux.sec in the case of negative chargings for photosensitive member C. Also the surface potential $V_{01}$ charged by the pre-hysteresis subcharger 13 alone should be at least $\pm 700$ V and about $\pm 900$ to $\pm 1200$ V when added to $V_{00}$.

Furthermore, although the foregoing experiments were conducted with the use of white light as the light source for the eraser 14, a monochromatic light source may be used instead to attain the same effects. Such arrangement is particularly effective in a semiconductor laser beam printer when monochromatic light of the same wavelength as the laser is used.

Figure 25:
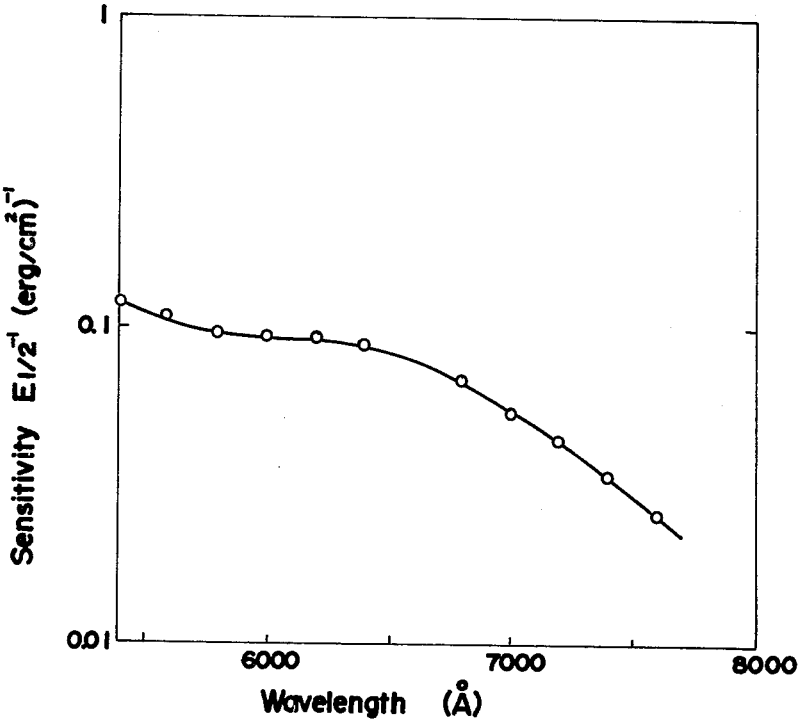
FIGS. 25 and 26 are graphs respectively showing spectral sensitivity of the photosensitive members including $CdS.nCdCO_3$ and $CdS_{0.7}Se_{0.3}.nCdCO_3$ as the photoconductive materials.

FIG. 25 shows the characteristic of spectral sensitivity of $CdS.nCdCO_3$ resin binder type photosensitive member B sensitized by the copying method according to the present invention. With $V_{01}$ set to equal to $-1000$ V, Er of 250 lux.sec and charging the photosensitive member to surface potential $V_{02}$ of $-600$ V, light illumination is effected by successively varying the range of wavelength from 5400 Å to 7600 Å by the use of a monochrometer and the sensitivities measured by reciprocals of light energy ($E_{\frac{1}{2}}$) required to decay $V_{02}$ to half of its value. This condition corresponds to the case of twofold sensitization as is apparent from FIG. 10. The results show that the photosensitive member B is sensitized highly not only in the visible spectrum but also in the long wavelength spectrum of greater than 7000 Å indicating that the present invention makes possible the use of this member in the laser beam printer.

Figure 26:
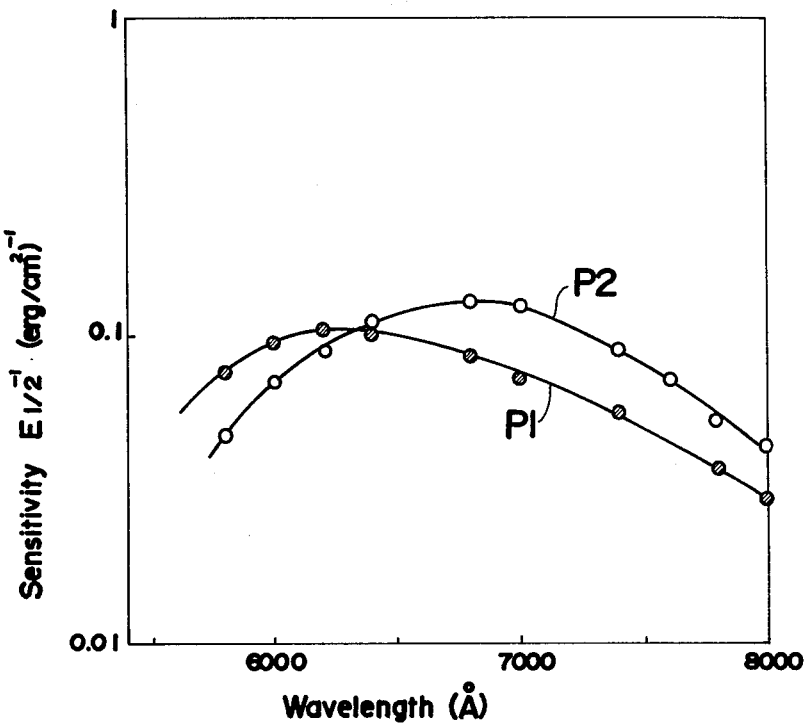

FIG. 26 shows the spectral sensitivity characteristic of a $CdS_{0.7}Se_{0.3}.nCdCO_3$ resin binder type photosensitive member C sensitized by the copying method according to the present invention. Curve P2 is the case of positive chargings with $V_{01}$ of 1000 V, Er of 50 lux.sec and $V_{02}$ of 600 V and corresponds to twofold sensitization. Curve P1 is the case of negative chargings with $V_{01}$ of −1000 V, Er of 50 lux.sec and $V_{02}$ of −600 V and corresponds to twofold sensitization. Regardless of the charging polarity, the photosensitive member is sensitized highly in the visible spectrum as well as in the long wavelength spectrum of 7000 to 8000 Å. Accordingly, the copying method of the present invention is also applicable to the semiconductor laser beam printer.

Experiments were conducted in the same manner as above with use of the following drums prepared from other compositions under different conditions.

Photosensitive member D

Here, a $CdS_xSe_{1-x}.nCdCO_3$ resin binder type photosensitive member (x=0.5, n=1) same as C was prepared by a different manufacturing method.

An aqueous solution containing 308.5 grams of cadmium nitrate and 0.16 grams of cupric chloride was admixed with an aqueous solution of ammonium carbonate to form a precipitate of $CdCO_3$(Cu). Followed thereby, hydrogen sulfide gas was bubbled through this solution at a rate of 0.5 liter per minute for 11 minutes and then also bubbling hydrogen selenide gas at a rate of 0.5 liter per minute for 11 minutes to obtain a precipitate of $CdS_{0.5}.Se_{0.5}.nCdCO_3$. This precipitate was then rinsed, dried, ground, and calcined at a temperature of 250° C. for 15 hours to obtain photoconductive fine powder of $CdS_{0.7}Se_{0.3}.nCdCO_3$. This fine powder is then dispersed along with thermosetting acryl resin (Acrydic A405 available from Dainippon Ink Co.) and xylene solution and then coated onto an aluminum drum of 120 mmm in diameter by spraying into a thickness of about 30 microns and subsequently heat cured. Over this photoconductive layer, a solution containing xylene and thermosetting acryl resin was then coated into a thickness of about 1 micron to form an insulating protective layer.

This photosensitive member D was used as the drum 1 of the apparatus in FIG. 3 and the same tests as photosensitive member C were conducted. The results were quite similar and the photosensitive member D was sensitized as much as 1.4-fold at Er of 500 lux.sec and twice at Er of 100 lux.sec in the case of positive chargings with $V_{01}$ of 1000 V and $V_{02}$ of 600 V. In the case of negative chargings, twofold sensitization was achieved with Er of about 50 lux.sec provided that $V_{01}$ equals −1000 V and $V_{02}$ is −600 V. The first drum rotation effect ($\Delta Vi_2$ (2-1)) as well as sensitivity variations after a cessation ($\Delta Vi_2$ (20-1), $\Delta V_{02}$ (20-1)) were both less than ±50 V and showed stable characteritics by setting Er to about 50 to 500 lux.sec.

Photosensitive member E

Here, a resin binder type photosensitive member using $CdS_xSe_{1-x}.nCdCO_3$ (x=0.95; n=1) was prepared.

An aqueous solution containing 308.5 grams of cadmium nitrate and 0.16 grams of cupric chloride was admixed with an aqueous solution of ammonium carbonate to form a precipitate of $CdCO_3$(Cu). Following this, an aqueous solution containing 32.4 grams of ammonium sulfide and 3.25 grams of ammonium selenide was dropped in small amounts into the above solution mixture to thereby obtain a precipitate of $CdS_{0.95}Se_{0.5}.nCdCO_3$. This precipitate was then rinsed, dried, ground and calcined at a temperature of 250° C. for 15 hours to obtain a fine photoconductive powder of $CdS_{0.95}Se_{0.05}.nCdCO_3$. This fine powder was then dispersed, along with a thermosetting acryl resin (Acrydic A405 available from Dainippon Ink Co.) and xylene solution and the product was then coated onto an aluminum drum 120 mm in diameter by spraying to provide a thickness of about 30 microns. The heat curable layer subsequently was heat cured. Over this photoconductive layer, a solution containing xylene and a thermosetting acryl resin was then coated into a thickness of about 1 micron to form an insulating protective layer.

Figure 27:
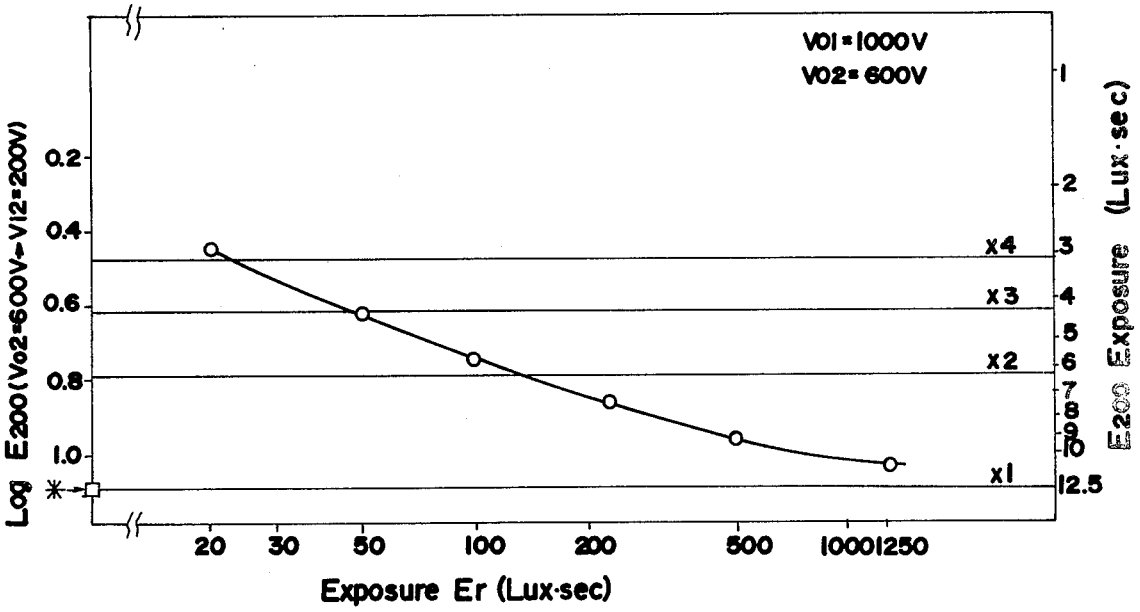
FIGS. 27 and 28 are graphs showing respectively the dependency of the photosensitivity of the photosensitive member relative to an amount of exposure by a light eraser when $CdS_{0.95}Se_{0.05}.nCdCO_3$ ($0<n\leqq 4$) is used as a photoconductive material in the photosensitive member.
Figure 28:
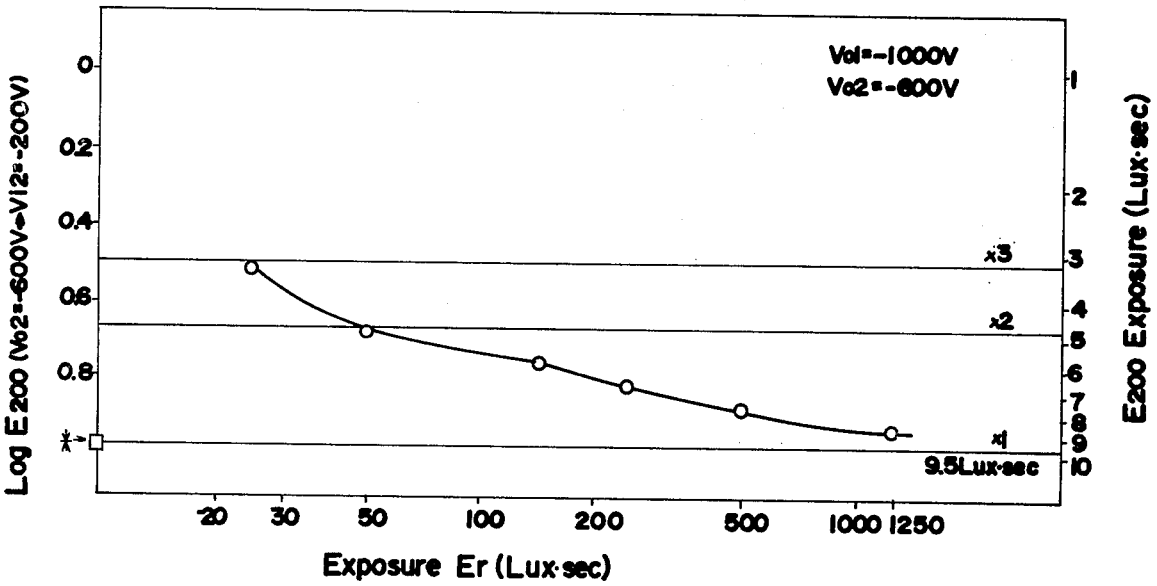

This photosensitive member E was used as the drum 1 of the apparatus in FIG. 3 and the same tests as photosensitive member C were conducted. FIG. 27 similar to FIG. 11 shows the degree of sensitization in the cases of positive charging polarities. Photosensitivity E200 of this photosensitive member E by the copying method with no process through the transfer charger 8 and the sensitizing unit 12 but with high illumination exposure of about 5000 lux.sec by the eraser 14 is about 12.5 lux.sec and this will be taken as the reference sensitivity (X1). With $V_{01}$ of 1000 V and $V_{02}$ of 600 V, twofold sensitization is attained with the exposure amount Er of about 100 lux.sec and maximum of about fourfold sensitization with Er of about 20 lux.sec.

With the reference sensitivity of 9.5 lux.sec by the high illumination exposure amount of 5000 lux.sec and when the charging polarities in the pre-hysteresis sensitization step and the electrostatic latent image forming step were all set to negative polarities with $V_{01}$ equal to −1000 V, the photosensitive member E was sensitized nearly as much as threefold with the erasing exposure amount Er of about 25 lux.sec and twofold with Er of 50 lux.sec. Even with Er of 215 lux.sec, 1.5-fold sensitization is attained. First drum rotation effect ($\Delta Vi_2$ (2-1)) as well as sensitivity variations after a cessation ($\Delta Vi_2$ (20-1), $\Delta V_{02}$(20-1)) were quite similar as photosensitive member C for both positive and negative polarities and showed stable characteristics by setting Er to about 50 to 500 lux.sec.

Photosensitive member F

Here, a resin binder type photosensitive member using CdS as the photoconductive material was prepared.

A solution of 50 parts by weight of thermosetting acrylic resin (Acrydic A405 available from Dainippon Ink Co.) in 120 parts by weight of an organic solvent mixture consisting chiefly of xylene was added to 100 parts by weight of finely divided CdS(Cu) containing 0.1 atomic % Cu per 100 atomic % Cd. The mixture was thoroughly kneaded, then applied by spraying onto an aluminum drum 120 mm in diameter and thereafter cured with heating to prepare a photosensitive member F in a form of a drum having a photoconductive layer about 30 microns in thickness.

Figure 29:
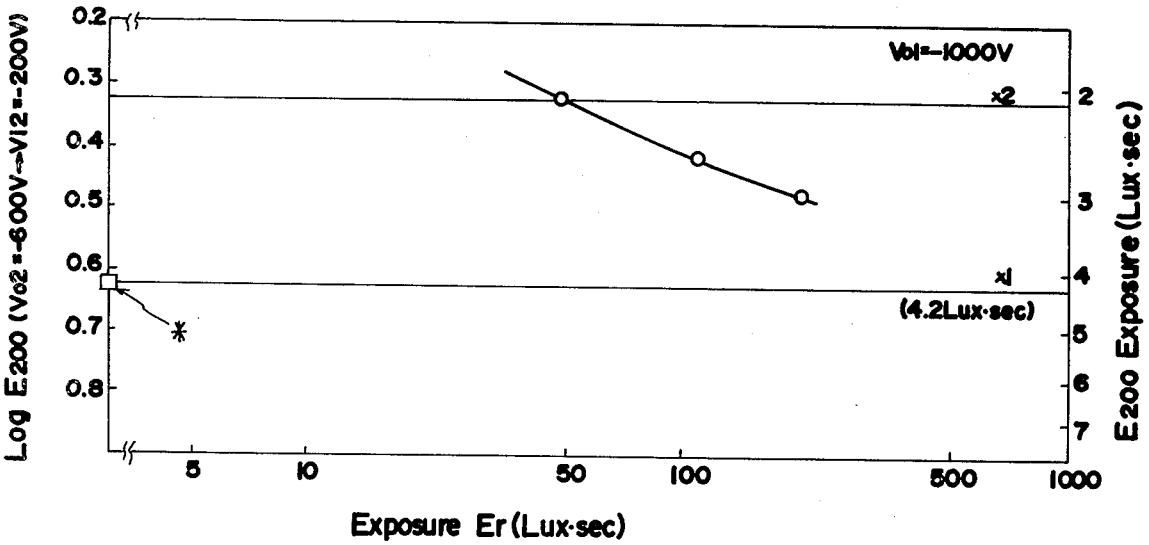
FIGS. 29 to 31 are graphs respectively showing the dependency of photosensitivity relative to an amount of exposure by a light eraser when CdS and $(CdS)_{0.4}(CdSe)_{0.6}.nCdCO_3$ are used as photoconductive materials in the photosensitive members.

FIG. 29 shows the dependence of photosensitivity E200 of photosensitive member F on the amount of sub-erasing exposure Er. The mark * indicates the sensitivity of 4.2 lux.sec afforded by the conventional copying method. Under the conditions of $V_{01}$ of −1000 V and $V_{02}$ of −600 V, twofold sensitization is achieved with an Er of about 50 lux.sec. In practice, Er may be as high as 200 lux.sec to achieve 1.5-fold sensitization. By setting Er equal to about 50 to 300 lux.sec, front half fogging as well as image density difference resulting from the sensitivity variations after a cessation were effectively prevented.

Photosensitive member G

Here, a resin binder type photosensitive member using $(CdS)_x(CdSe)_{1-x}.nCdCO_3$ (x=0.4, n=0.5) as the photoconductive material was prepared.

An aqueous solution containing 308.5 grams of cadmium nitrate and 0.16 grams of cupric chloride were admixed with an aqueous solution of ammonium carbonate to form a precipitate of $CdCO_3(Cu)$. Two solutions containing the same precipitate were prepared and through one of the solutions, hydrogen sulfide gas was bubbled at a rate of 0.5 liter per minute for 12.5 minutes to obtain the precipitate of $CdS.nCdCO_3$ and through the other solution, hydrogen selenide gas was bubbled at a rate of 0.5 liter per minute for 18 minutes to obtain the precipitate of $CdSe.nCdCO_3$. Each of these precipitates was then rinsed, dried, ground and calcined at a temperature of 250° C. for 15 hours to obtain photoconductive fine powders of $CdS.nCdCO_3$ and $CdSe.nCdCO_3$. 40 grams of $CdS.nCdCO_3$ powder and 60 grams of $CdSe.nCdCO_3$ were then dispersed along with thermosetting acryl resin (Acrydic A405 available from Dainippon Ink. Co.) and xylene solution and then coated onto an aluminum drum of 120 mm in diameter by spraying into a thickness of about 30 microns and subsequently heat cured to form a photoconductive layer of $(CdS)_{0.4}(CdSe)_{0.6}.nCdCO_3$.

Figure 30:
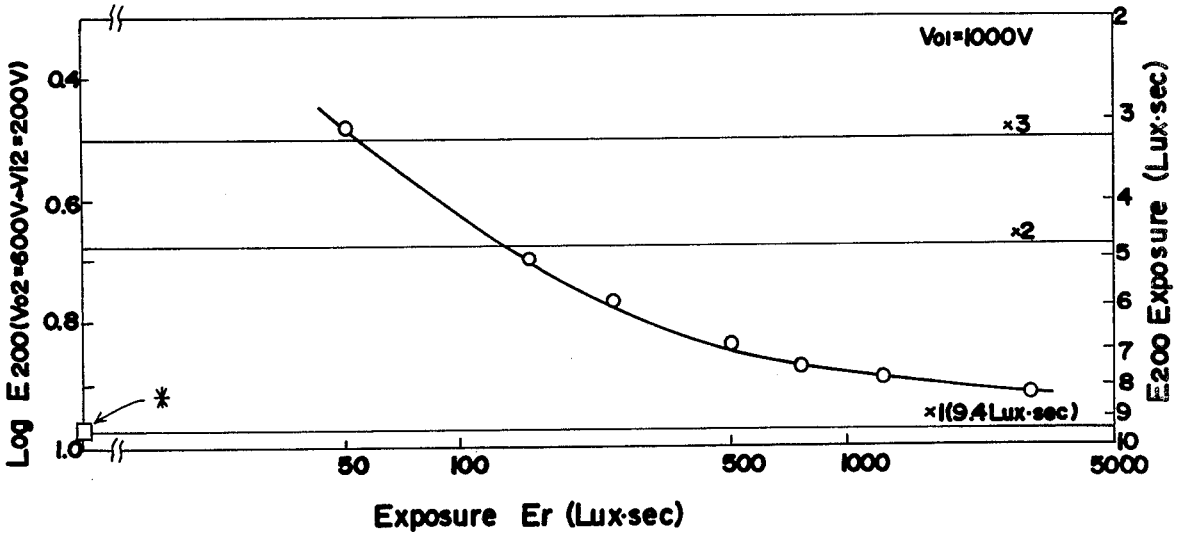
Figure 31:
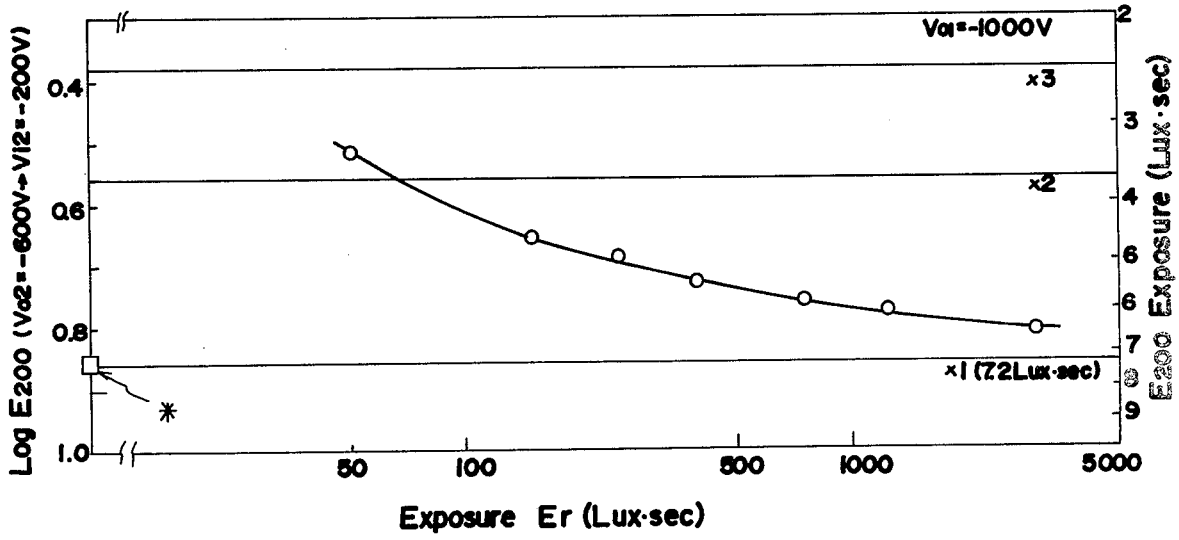

FIGS. 30 and 31 respectively show the degree of sensitization for both positive and negative chargings. The marks * indicate the sensitivities of 9.4 lux.sec for positive chargings and 7.2 lux.sec for negative chargings afforded by the conventional copying method. In both cases, twofold sensitizations are achieved with an Er of about 50 lux.sec and in practice, Er may be as high as 500 lux.sec to achieve a minimum of 1.5-fold sensitization. A suitable range for Er without causing copy stains was about 50 to 500 lux.sec.

The photosensitive member to be used in this invention may of course be in the form of a film, belt or the like other than a drum.

While there have been described preferred embodiments of the present invention, additions and omissions may be made without departing from the spirit thereof.

What is claimed is:

1. In an electrophotographic copying method suitable for a toner image transfer type copying apparatus in which at least a portion of a photosensitive member is used repeatedly for forming an image of an original to be copied and in which said photosensitive member comprises at least a photoconductive layer formed over a conductive base which is prepared from a dispersion of a photoconductive material including at least cadmium sulfide in a binder resin, the method comprising:

a first step of charging said photosensitive member with a specific charge polarity by the charge imparted to the photosensitive member by the toner image transfer charger means during transfer of the image from the photosensitive member to the copy medium;

a second step of charging said photosensitive member with said specific charge polarity as said first step by a pre-hysteresis charger means;

a third step of exposing said photosensitive member to light by a pre-hysteresis eraser means of substantially no greater than 750 lux sec to sensitize said photosensitive member, said first and second steps of charging being sufficiently high to saturate the degree of sensitization of said photosensitive member;

a fourth step of uniformly charging said photosensitive member with the same charge polarity as said first and second steps by a charging means, and wherein the time for the portion of said photosensitive member sensitized in said third step to reach said fourth step is less than substantially a maximum of 3 seconds;

a fifth step of exposing said photosensitive member to the image to form an electrostatic latent image; and a sixth step of developing said electrostatic latent image for subsequent transfer thereof.

2. The electrophotographic copying method as claimed in claim 1 wherein said photoconductive material is selected from a group consisting of (1) $CdS_xSe_{1-x}.nCdCO_3$ ($0.1 \leqq x \leqq 1$; $0 < n \leqq 4$), (2) CdS and (3) $(CdS)_x(CdSe)_{1-x}.nCdCO_3$($0.1 \leqq x \leqq 0.99$, $0 < n \leqq 4$).

3. The electrophotographic copying method as claimed in claim 2 wherein said photosensitive member further comprises a light transparent insulating protective layer on said photoconductive layer.

4. In an electrophotographic copying method suitable for a toner image transfer type copying apparatus in which at least a portion of a photosensitive member is used repeatedly for forming an image to be copied and in which said photosensitive member comprises at least a photoconductive layer formed over a conductive base which is prepared from a dispersion of a photoconductive material selective from a group consisting of (1) $CdS_xSe_{1-x}.nCdCO_3$ wherein $0.1 \leqq x \leqq 1$; $0 < n \leqq 4$, (2) CdS and (3) $(CdS)_x(CdSe)_{1-x}.nCdCO_3$ wherein $0.1 \leqq x \leqq 0.99$; $0 < n \leqq 4$ in a resin binder, the method comprising:

a first step of charging said photosensitive member with a specific charge polarity by the charge imparted to the photosensitive member by the toner image transfer charger means during transfer of the image from the photosensitive member to the copy medium;

a second step of charging said photosensitive member with said specific charge polarity as said first step;

a third step of exposing said photosensitive member to light of substantially 50 to 750 lux.sec for photoconductive material of type (1) when x equals 1, substantially 25 to 750 lux. sec for photoconductive material of type (1) when x is less than 1, substantially 50 to 300 lux.sec for photoconductive material of type (2) and substantially 50 to 500 lux.sec for photoconductive material of type (3), the photosensitive member is sensitized higher as the amount of exposure in the third step is decreased and said first and second steps being effected to charge the photosensitive member to a sufficiently high potential such that the degree of sensitization becomes substantially independent of the potential above a certain value;

a fourth step of uniformly charging said photosensitive member with the same charge polarity as said first and second steps, the time for the portion of said photosensitive member sensitized in said third step to reach said fourth step is less than substantially a maximum of 3 seconds;

a fifth step of exposing said photosensitive member to the image to form an electrostatic latent image; and a sixth step of developing said electrostatic latent image for subsequent transfer thereof.

5. The electrophotographic copying method as claimed in claim 4 wherein said photosensitive member further comprises a light transparent insulating protective layer on said photoconductive layer.

6. The electrophotographic copying method as claimed in claim 4 wherein the potential obtained after said second step is substantially 900 to 1200 volts.

* * * * *